US007673852B2

(12) United States Patent
Gibson et al.

(10) Patent No.: US 7,673,852 B2
(45) Date of Patent: Mar. 9, 2010

(54) FENCE MOUNTING DEVICE

(75) Inventors: Kevin Gibson, Enon, OH (US); Randy Woldruff, Enon, OH (US)

(73) Assignee: Rankev LLC, Enon, OH (US)

( * ) Notice: Subject to any disclaimer, the term of this patent is extended or adjusted under 35 U.S.C. 154(b) by 751 days.

(21) Appl. No.: 11/450,571

(22) Filed: Jun. 9, 2006

(65) Prior Publication Data

US 2007/0007504 A1 Jan. 11, 2007

Related U.S. Application Data

(60) Provisional application No. 60/696,628, filed on Jul. 5, 2005.

(51) Int. Cl.
*E04H 17/14* (2006.01)

(52) U.S. Cl. ..... 256/19; 256/24; 256/45; 256/64; 256/DIG. 5

(58) Field of Classification Search ..... 256/1, 256/5, 19, 23, 24, 30–36, 45, 58–64, 65.01, 256/65.14, DIG. 5, DIG. 6; 405/216
See application file for complete search history.

(56) References Cited

U.S. PATENT DOCUMENTS

| | | | | | |
|---|---|---|---|---|---|
| 458,821 | A | | 9/1891 | Brookbank | |
| 800,877 | A | | 10/1905 | Pevoto | |
| 1,006,796 | A | | 10/1911 | Rupp | |
| 1,852,910 | A | | 4/1932 | Williams et al. | |
| 2,025,289 | A | | 12/1935 | Kastein | |
| 3,083,494 | A | | 4/1963 | Lindenbaum | |
| 3,347,527 | A | | 10/1967 | Andrews | |
| 3,379,218 | A | * | 4/1968 | Conde | 138/99 |
| 3,820,758 | A | | 6/1974 | Berg, Jr. et al. | |
| 4,054,269 | A | | 10/1977 | Stabler | |
| 4,077,611 | A | | 3/1978 | Wilson | |
| 4,124,198 | A | | 11/1978 | Wong | |
| 4,191,361 | A | | 3/1980 | Jensen | |
| 4,366,949 | A | | 1/1983 | Staub, Sr. | |
| 4,371,578 | A | * | 2/1983 | Thompson | 428/192 |
| 4,448,824 | A | * | 5/1984 | Holmes et al. | 428/33 |
| 4,532,168 | A | * | 7/1985 | Steele et al. | 428/99 |
| 4,576,364 | A | | 3/1986 | O'Fearna | |
| 4,621,783 | A | | 11/1986 | Wier | |
| 4,644,715 | A | * | 2/1987 | Burell et al. | 52/170 |
| 4,699,821 | A | * | 10/1987 | Hallock | 428/192 |
| 4,731,273 | A | * | 3/1988 | Bonk et al. | 428/57 |
| 4,764,054 | A | * | 8/1988 | Sutton | 405/216 |
| 5,138,806 | A | * | 8/1992 | Marx et al. | 52/170 |
| 5,152,508 | A | | 10/1992 | Fish | |
| 5,180,143 | A | | 1/1993 | Brower | |
| 5,409,196 | A | * | 4/1995 | Specht | 256/54 |

(Continued)

*Primary Examiner*—Michael P Ferguson
*Assistant Examiner*—Nahid Amiri
(74) *Attorney, Agent, or Firm*—Gallagher & Dawsey Co., LPA; Michael J. Gallagher; David J. Dawsey

(57) ABSTRACT

A fence post sleeve designed to allow the quick and easy erection of a temporary fencing structure without the use of installation tools. The fence post sleeve is a generally tubular structure having at least two barrier fence clips and a longitudinal slit. The fence post sleeve is designed to cooperate with a number of common fence posts. The barrier fence clips releasably secure flexible barrier fencing to the fence post sleeve, and thus the fence post. The fence post sleeve is particularly useful in the installation of construction fencing and other forms of temporary barrier fencing.

13 Claims, 22 Drawing Sheets

U.S. PATENT DOCUMENTS 5,431,372 A * 7/1995 Kostelecky ..... 256/64
5,435,667 A * 7/1995 Strange ..... 405/216
5,516,236 A * 5/1996 Williams et al. ..... 405/216
5,573,227 A * 11/1996 Hemauer et al. ..... 256/65.06
5,676,351 A 10/1997 Speece et al.
5,758,868 A 6/1998 Shea
5,910,130 A 6/1999 Caizza et al.
6,053,281 A * 4/2000 Murray ..... 182/113
6,149,135 A * 11/2000 Hlavin ..... 256/24
6,336,623 B1 * 1/2002 McCarthy ..... 256/64
6,364,575 B1 * 4/2002 Bradley et al. ..... 405/216
6,612,551 B1 * 9/2003 Roy ..... 256/1
6,679,482 B2 * 1/2004 Allenbaugh ..... 256/65.14
6,824,122 B2 11/2004 Spyrakis
7,118,096 B2 * 10/2006 Petrozziello ..... 256/32

* cited by examiner

FENCE MOUNTING DEVICE

RELATED APPLICATIONS

This application claims the benefit of U.S. provisional patent application Ser. No. 60/696,628, filed Jul. 5, 2005, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present invention relates to the field of temporary fencing systems; particularly, to a fence post sleeve adapted for releasably mounting on a fence post that releasably secures flexible temporary barrier fence to the fence, post sleeve.

BACKGROUND OF THE INVENTION

The erection of a temporary fence, like one used at a construction site or carnival, can be an expensive and difficult task. It is frequently accomplished by installation of posts or some other mountable material, such as rebar, followed by the labor intensive task of manually attaching flexible barrier fencing to the posts via cables or ties, usually requiring special tools or equipment. When the temporary fence is no longer needed, the user normally dismantles it by tearing away the fencing material from the posts, creating tears in the fence where it was attached to the post. This process presents multiple efficiency problems. One problem is the fact that this method of installation requires a significant amount of manpower and time to erect the temporary fence, due to the requirement that the cable or ties must be individually installed. Additionally, this inefficient method requires destruction of the flexible barrier fencing in order to break down the temporary fence.

The present invention advances the art by providing a convenient means to install and dismantle a temporary flexible barrier fencing system. The invention allows ease of installation of the system which reduces the manpower required to erect such a fence. In addition, the invention is an improvement over the prior art due to the fact that no specialized tools are required for installation. Finally, the temporary fencing system of the disclosed invention can be efficiently dismantled while preserving the assembly for re-use at a later date.

SUMMARY OF INVENTION

In its most general configuration, the present invention advances the state of the art with a variety of new capabilities and overcomes many of the shortcomings of prior methods in new and novel ways. In its most general sense, the present invention overcomes the shortcomings and limitations of the prior art in any of a number of generally effective configurations.

The fence mounting device of the present invention, called the fence post sleeve, is designed to serve the purpose of allowing the user to quickly and easily erect a temporary fencing structure without the use of installation tools. The fence post sleeve is designed to cooperate with a fence post.

The fence post sleeve may be either slid over and down a post from the top or, because the sleeve has a lengthwise longitudinal slit, the sleeve may be wrapped around the post.

The fence post sleeve has at least two barrier fence clips designed to releasably grip and hold a section of flexible barrier fencing against the fence post sleeve, and thus the fence post. The barrier fence clips can be oriented horizontally, vertically, or any other orientation.

In order to construct the fencing system, at least two fence posts are anchored in the ground or otherwise secured. Next, a fence post sleeve is releasably coupled with each fence post. Finally, the flexible barrier fencing is releasably connected to the fence post sleeves by using the barrier fence clips, to create the temporary fencing system.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The fence mounting device of the present invention enables a significant advance in the state of the art. The preferred embodiments of the invention accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
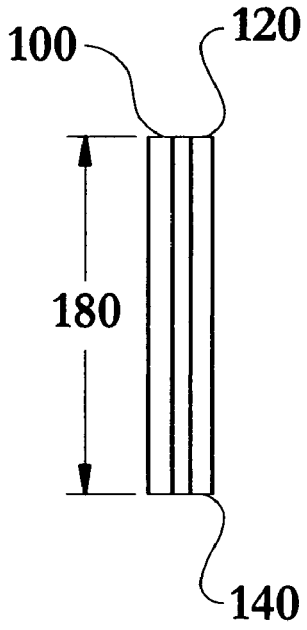
FIG. 1 shows a front elevation view of an embodiment of the fence post, not to scale.
Figure 3:
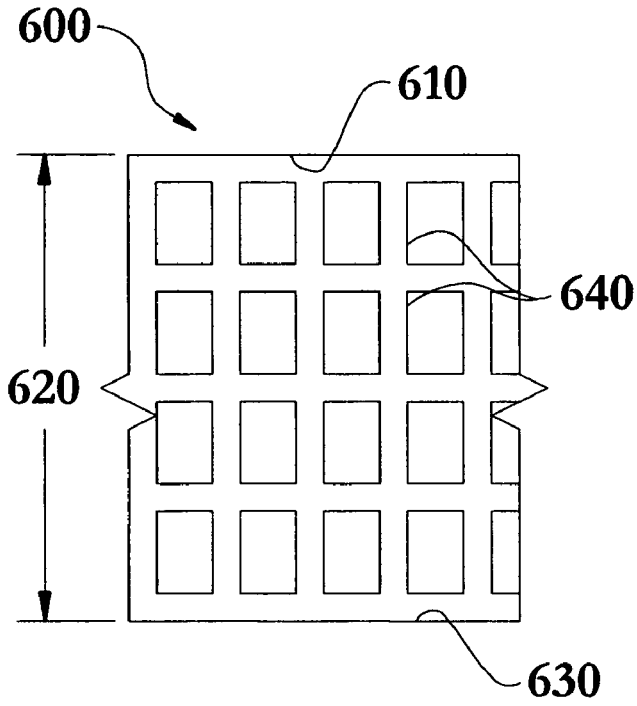
FIG. 3 shows a front elevation view of an embodiment of the flexible barrier fencing, not to scale.
Figure 2:
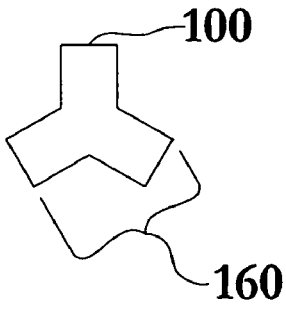
FIG. 2 shows a top plan view of the embodiment of FIG. 1, not to scale.

The fence mounting device of the present invention, as seen in FIGS. 4-8, called the fence post sleeve (300) is designed to serve the purpose of allowing the user to quickly and easily erect a temporary fencing structure without the use of installation tools. The fence post sleeve (300) can be easily conjoined with a fence post (100) having a post maximum cross-sectional width (160), a post bottom end (140), a post top end (120), and a post length (180) defined by the distance between the post bottom end (140) and the post top end (120), illustrated in FIGS. 1, 2 and 4. In addition, the fence post sleeve (300) is also designed to secure portions of flexible barrier fencing (600) having multiple openings (640), a top edge (610), a bottom edge (630), and a height (620) to the fence post (100), seen in FIGS. 3 and 5.

Figure 6:
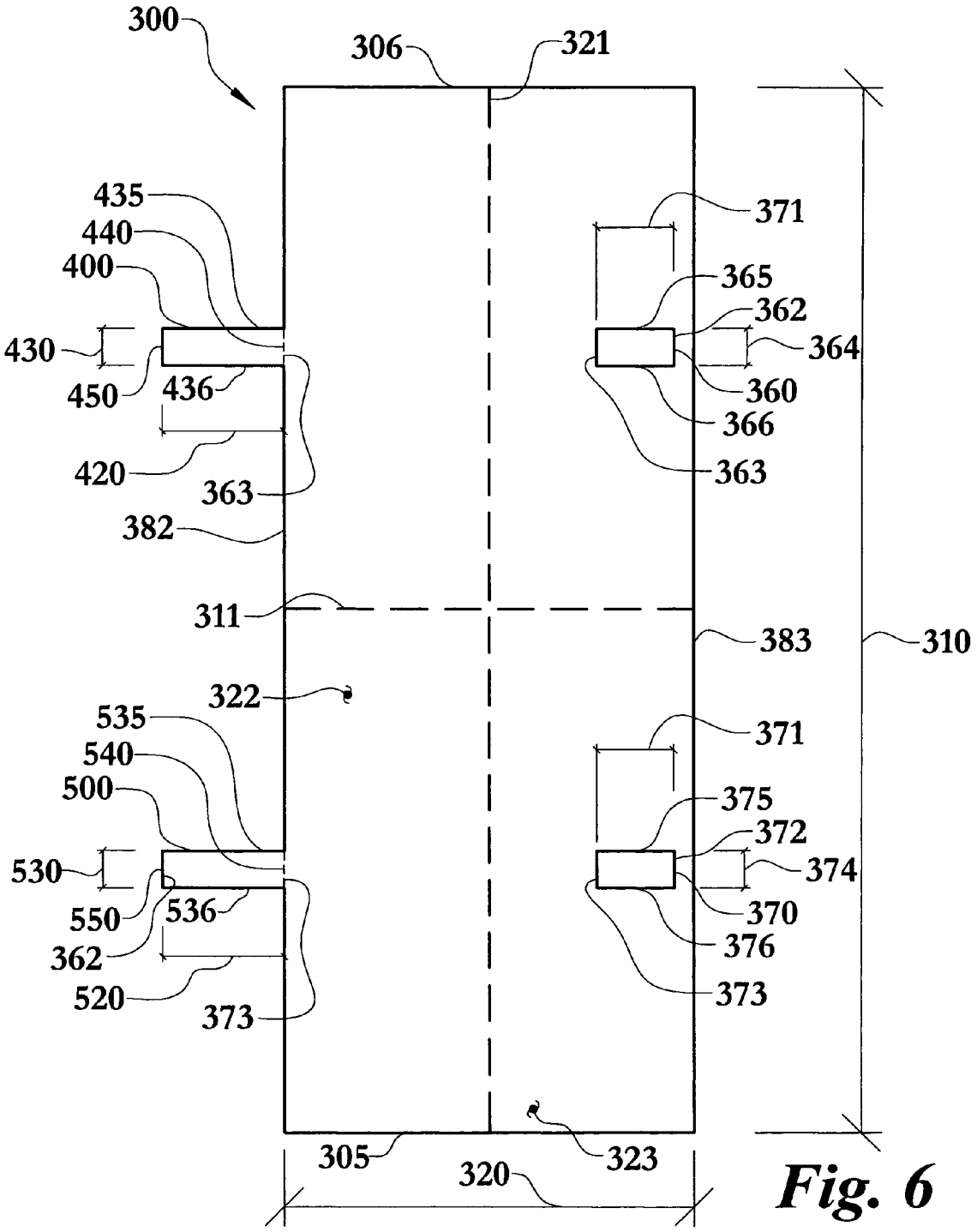
FIG. 6 shows a front elevation view of an embodiment of the fence post sleeve of the present invention in a flattened out state, not to scale.
Figure 7:
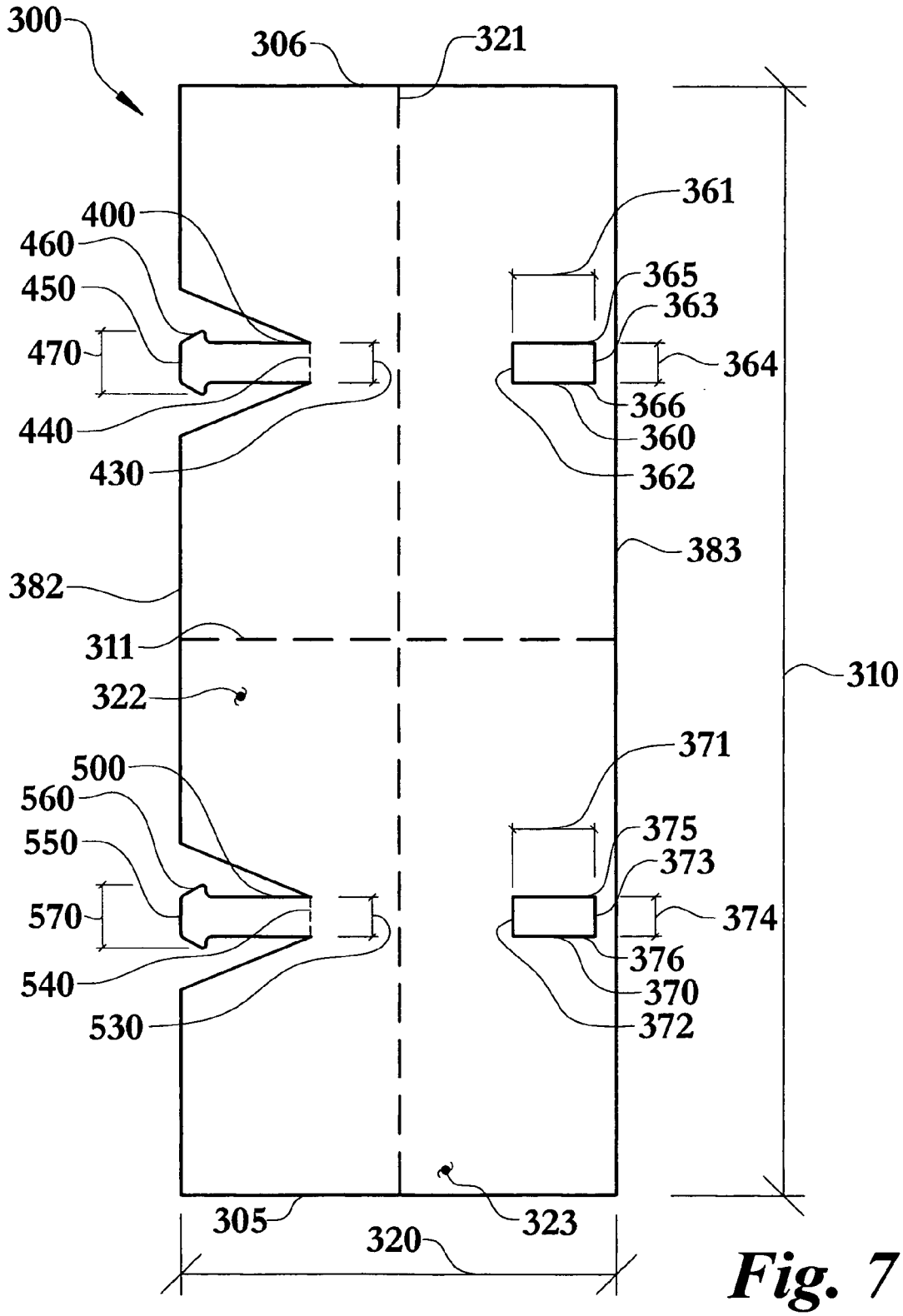
FIG. 7 shows a front elevation view of an embodiment of the fence post sleeve of the present invention in a flattened out state, not to scale.
Figure 8:
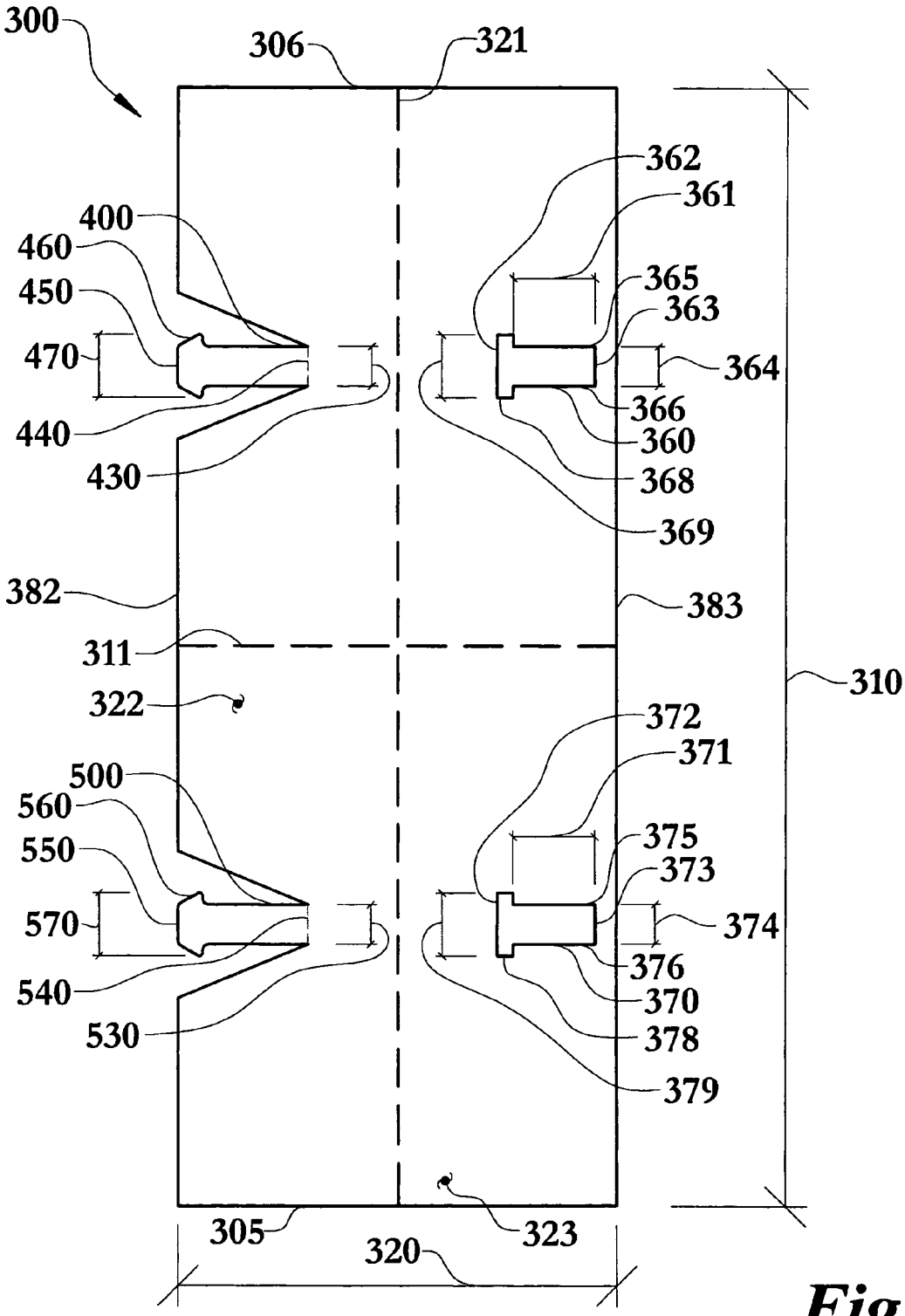
FIG. 8 shows a front elevation view of an embodiment of the fence post sleeve of the present invention in a flattened out state, not to scale.
Figure 12:
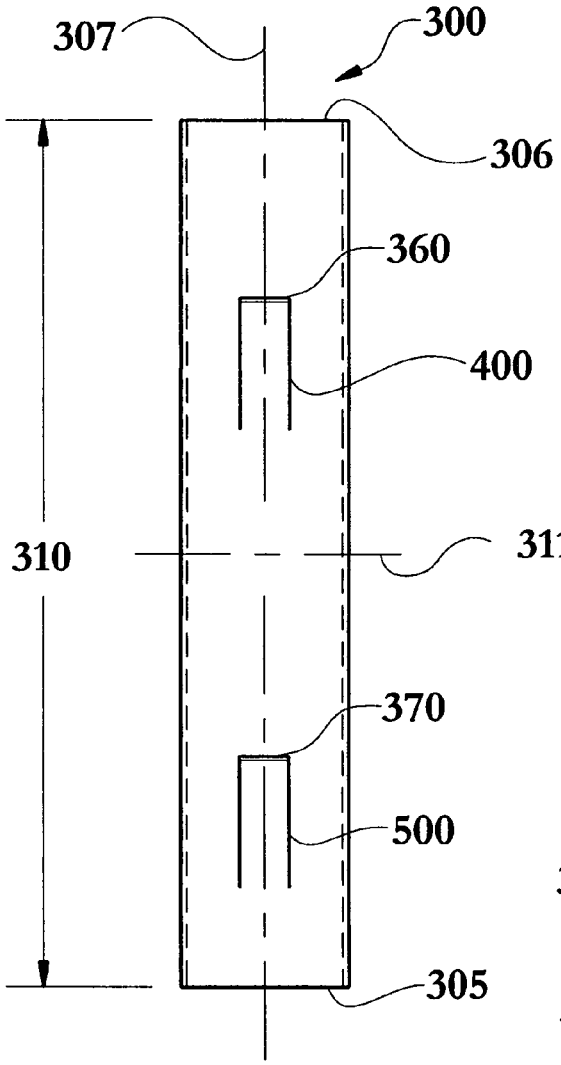
FIG. 12 shows a front elevation view of an embodiment of the post sleeve of the present invention with a variation of the top and bottom barrier fence clips, not to scale.
Figure 14:
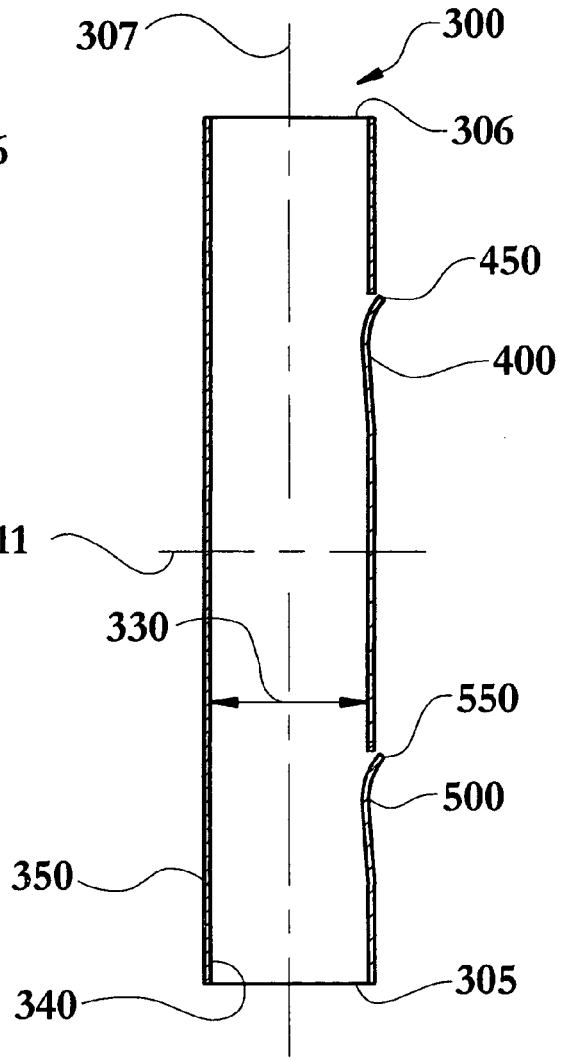
FIG. 14 shows a side cross-sectional view of the embodiment of FIG. 12, not to scale.
Figure 13:
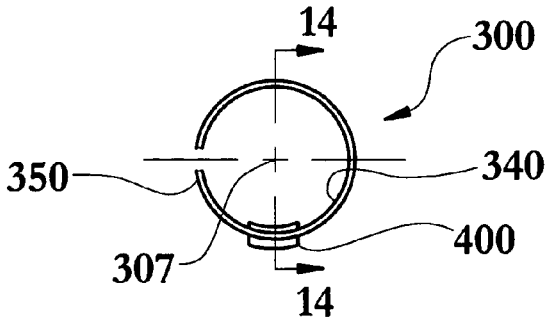
FIG. 13 shows a top plan view of the embodiment of FIG. 12, not to scale.

The fence post sleeve (300), illustrated in FIGS. 6-8, shown in an uncurled flattened position, has a fence post sleeve distal end (305), a fence post sleeve proximal end (306), and a fence post sleeve length (310), and a fence post sleeve length midpoint (311). In addition, the fence post sleeve (300) also has a fence post sleeve interior surface (340), a fence post sleeve interior minimum cross-sectional width (330), and a fence post sleeve exterior surface (350) as seen in FIGS. 12-14. A fence post sleeve central axis (307) extends from the distal end (305) to the proximal end (306) and is positioned at the midpoint of the interior minimum cross-sectional width (330).

Figure 4:
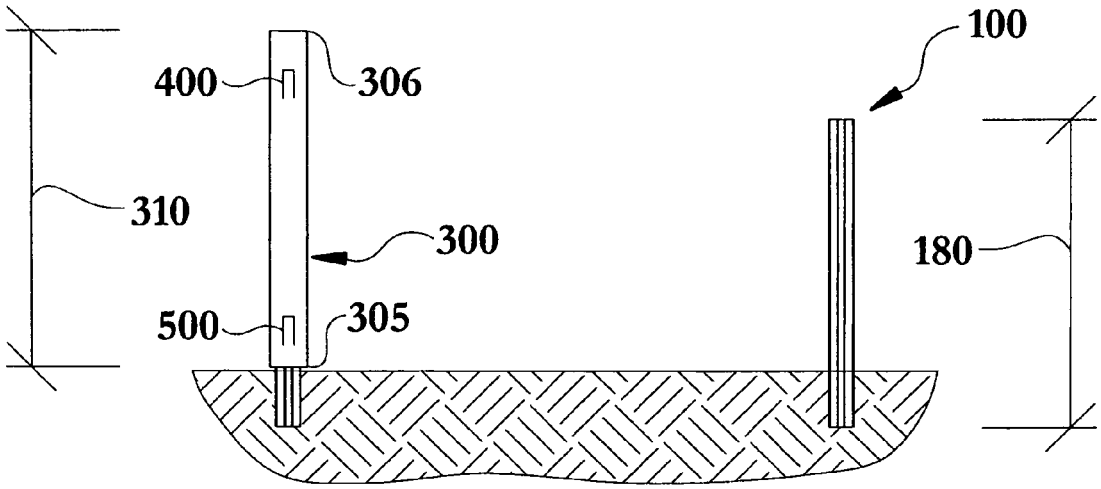
FIG. 4 shows a front elevation view of an embodiment of the fence post sleeve attached to a post, not to scale.

The fence post sleeve length (310) is defined by the distance between the distal end (305), and the proximal end (306), as seen in FIG. 6, and the fence post sleeve length midpoint (311) is substantially equidistant from the fence post sleeve distal end (305) and the fence post sleeve proximal end (306). In one configuration, the fence post sleeve length (310) may be shorter than the post length (180). In another embodiment, the fence post sleeve length (310) is longer than the post length (180), as shown in FIG. 4. By making the fence post length (310) longer than the post length (180) there is a reduced likelihood of impalement on a fence post (100). The fence post sleeve length (310) may be virtually any length, but in most temporary construction fencing applications the length (310) is approximately forty-eight inches.

Figure 9:
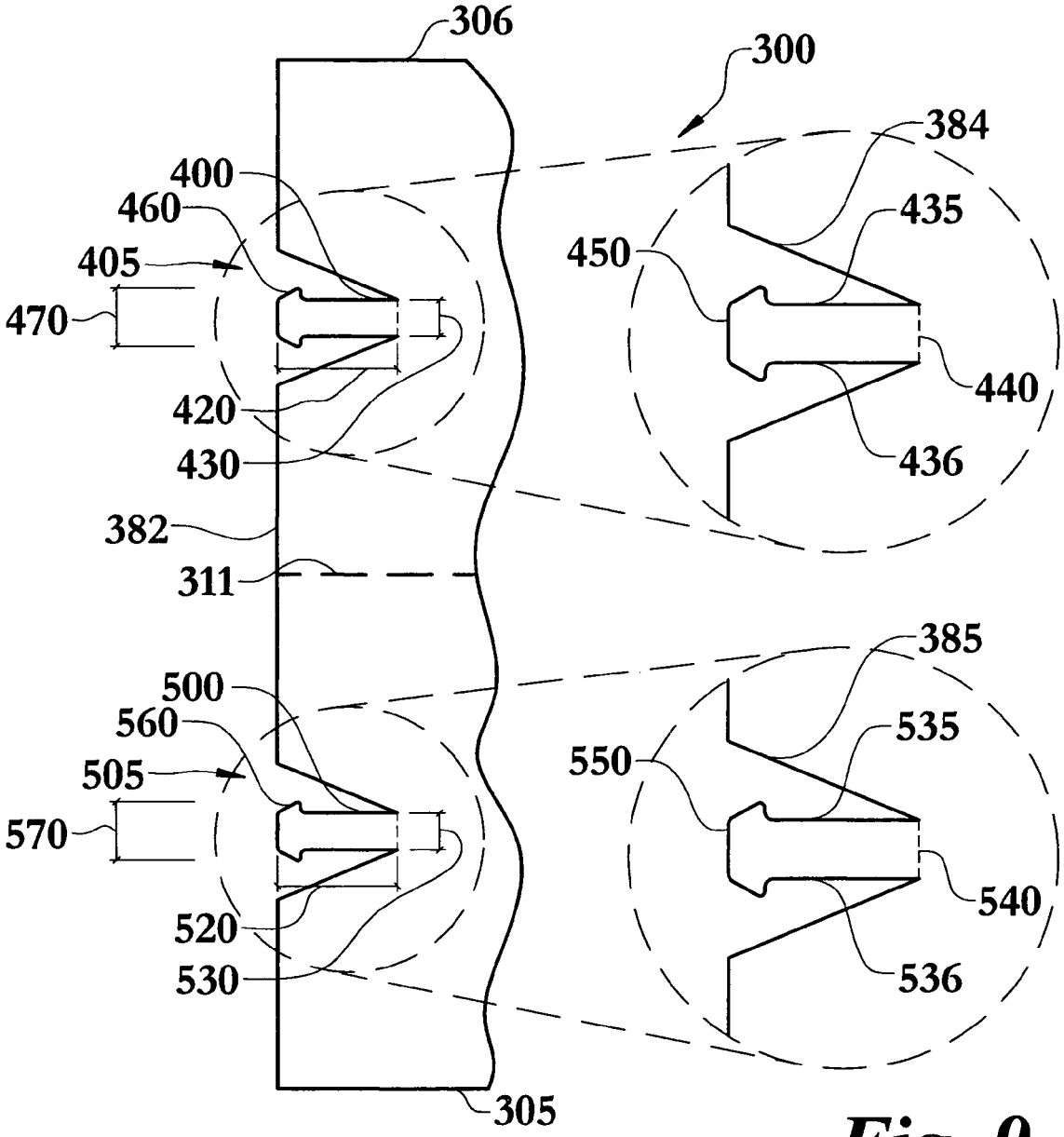
FIG. 9 shows a partial amplified view of FIG. 8, not to scale.
Figure 23:
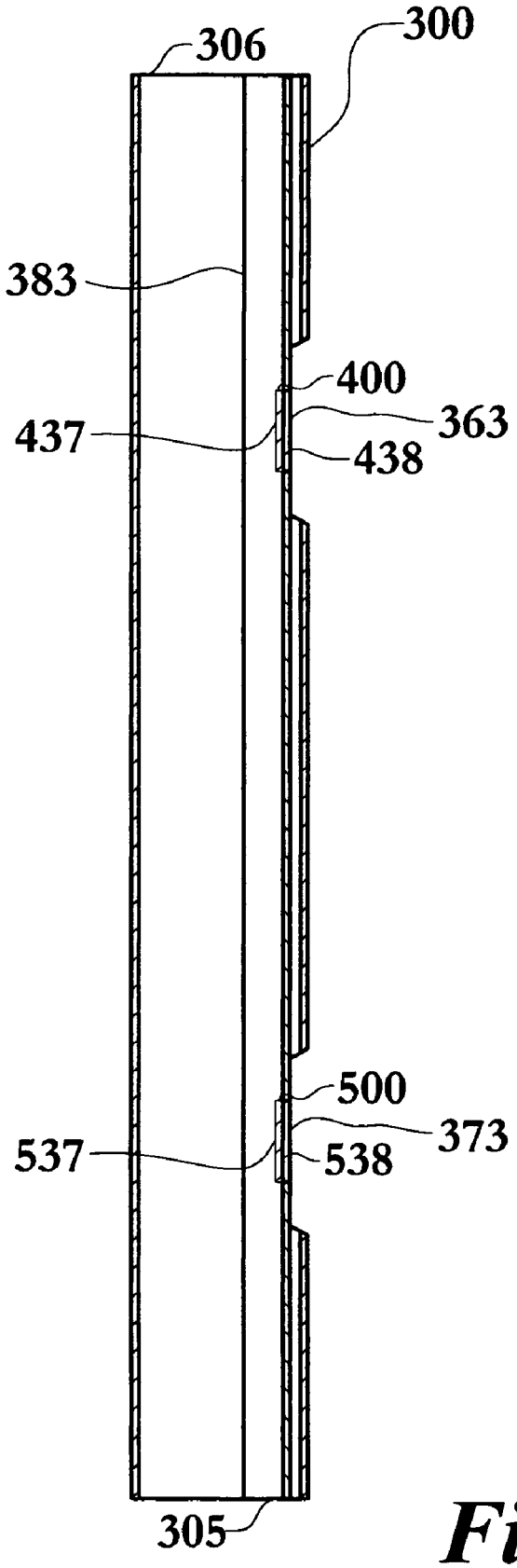
FIG. 23 shows a cross-sectional view taken along section line 23-23 of FIG. 21, not to scale.

The fence post sleeve (300) has at least one top barrier fence clip (400) at a top clip location (405) between the fence post sleeve length midpoint (311) and the fence post sleeve proximal end (306), and at least one bottom barrier fence clip (500) at a bottom clip location (505) between the fence post sleeve length midpoint (311) and the fence post sleeve distal end (305), as illustrated in FIG. 9. The top barrier fence clip (400) has a top clip attachment edge (440) and a top clip insertion edge (450), and the bottom barrier fence clip (500) has a bottom clip attachment edge (540) and a bottom clip insertion edge (550). In addition, the top barrier fence clip (400) has a top clip length (420), defined by the distance between the top clip attachment edge (440) and the top clip insertion edge (450), and a top clip width (430), defined by the distance between a top clip proximal edge (435) and a top clip distal edge (436), as seen in FIG. 9. Furthermore, the top barrier fence clip (400) has a top clip interior surface (437), and a top clip exterior surface (438), illustrated in FIG. 23. As seen in FIG. 9, the bottom barrier fence clip (500) has a bottom clip length (520), defined by the distance between the bottom clip attachment edge (540) and the bottom clip insertion edge (550), and a bottom clip width (530), defined by the distance between a bottom clip proximal edge (535) and a bottom clip distal edge (536). Furthermore, the bottom barrier fence clip (500) has a bottom clip interior surface (537), and a bottom clip exterior surface (538), illustrated in FIG. 23. The top barrier fence clip (400) and the bottom barrier fence clip (500) can have many different configurations.

In one embodiment, the top barrier fence clip (400) and the bottom barrier fence clip (500) are an integral and continuous portion of the fence post sleeve (300), as can bee seen in FIGS. 6-8. In this embodiment, the top barrier fence clip (400), bottom barrier fence clip (500), top clip receiving slot (360), and bottom clip receiving slot (370) can be formed by punching, stamping, or die cutting, material out of the fence post sleeve (300). In another embodiment, the top barrier fence clip (400) and the bottom barrier fence clip (500) are distinct and separate items attached to the fence post sleeve (300). In this latter embodiment, the top barrier fence clip (400), the bottom barrier fence clip (500) and the fence post sleeve (300) are connected at the top clip attachment edge (440) and the bottom clip attachment edge (540) by a connective device. Several different connective devices or methods can be used to attach the top barrier fence clip (400) and bottom barrier fence clip (500), and include but not limited to, mechanical fasteners, adhesives, welding, soldering, and other joining techniques known to one with skill in the art. Mechanical fasteners may include a nut and bolt, rivet, or screw. Finally, the fence post sleeve (300), including the top barrier fence clip (400) and bottom barrier fence clip (500), may consist of a plastic structure formed by injection molding, and may be constructed of, but not limited to, UV treated plastic.

Figure 10:
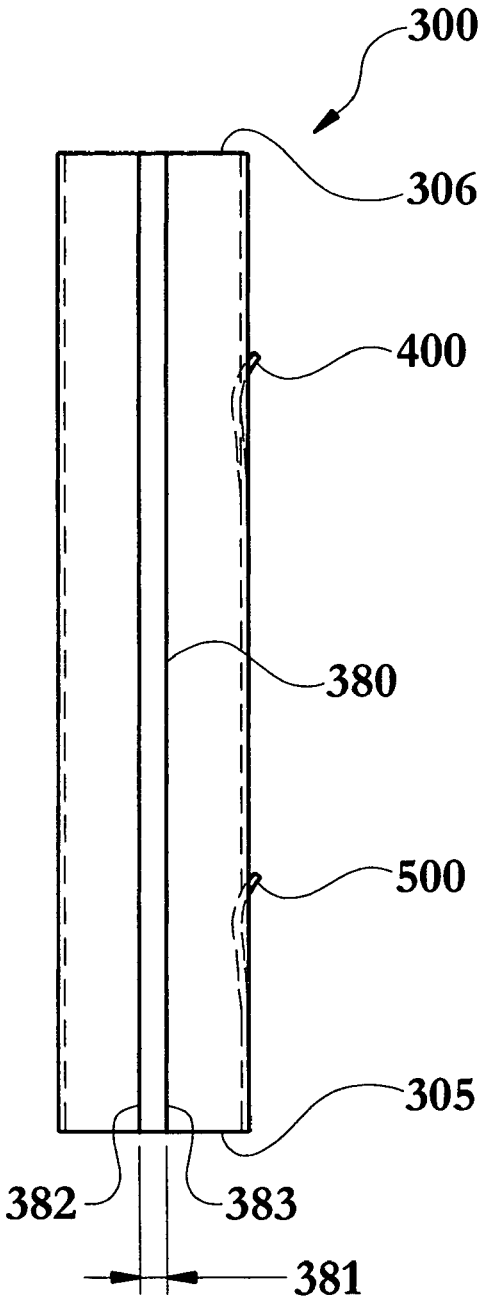
FIG. 10 shows a side elevation view of an embodiment of the post sleeve of the present invention with a variation of the fence post sleeve longitudinal slit, not to scale.
Figure 11:
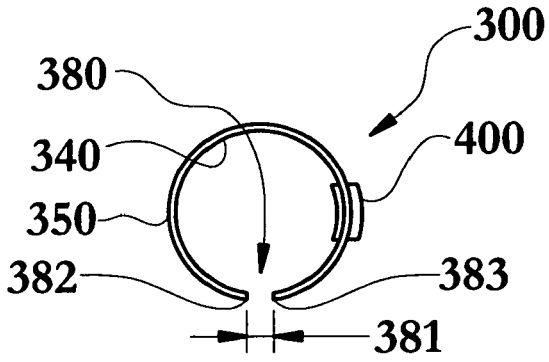
FIG. 11 shows a top plan view of the of the embodiment of FIG. 10, not to scale.

The fence post sleeve (300) has a fence post sleeve longitudinal slit (380) that extends from the fence post sleeve distal end (305) to the fence post sleeve proximal end (306), as illustrated in FIG. 10. In addition, the fence post sleeve longitudinal slit (380) has a fence post sleeve longitudinal slit separation distance (381), with a longitudinal slit left edge (382) and a longitudinal slit right edge (383), as seen in FIGS. 10 and 11. The fence post sleeve longitudinal slit (380) allows the internal minimum cross-sectional width (330) to increase in order to allow the fence post sleeve (300) to be slid onto a fence post (100).

The fence post sleeve (300) has a fence post sleeve width (320) and a fence post sleeve width midpoint (321) substantially equidistant from the longitudinal slit left edge (382) and the longitudinal slit right edge (383), as seen in FIGS. 6-8, wherein the fence post sleeve (300) is represented as being uncurled in a flat position. In addition, the fence post sleeve (300) has a left sleeve portion (322) that extends from the longitudinal slit left edge (382) to the fence post sleeve width midpoint (321), and bounded by the fence post sleeve distal end (305) and the fence post sleeve proximal end (306). Furthermore, the fence post sleeve (300) has a right sleeve portion (323) extending from the longitudinal slit right edge (383) to the fence post sleeve width midpoint (321) and bounded by the fence post sleeve distal end (305) and the fence post sleeve proximal end (306), wherein definition of the left sleeve portion (322) and the right sleeve portion (323) is merely for later convenience in describing the cooperation of various elements.

Figure 38:
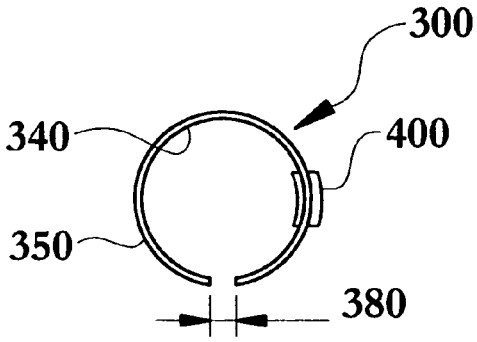
FIG. 38 shows a top plan view of an embodiment of the fence post sleeve, having a fence post sleeve longitudinal slit with a positive distance between the longitudinal slit left edge and the longitudinal slit right edge, not to scale.
Figure 45:
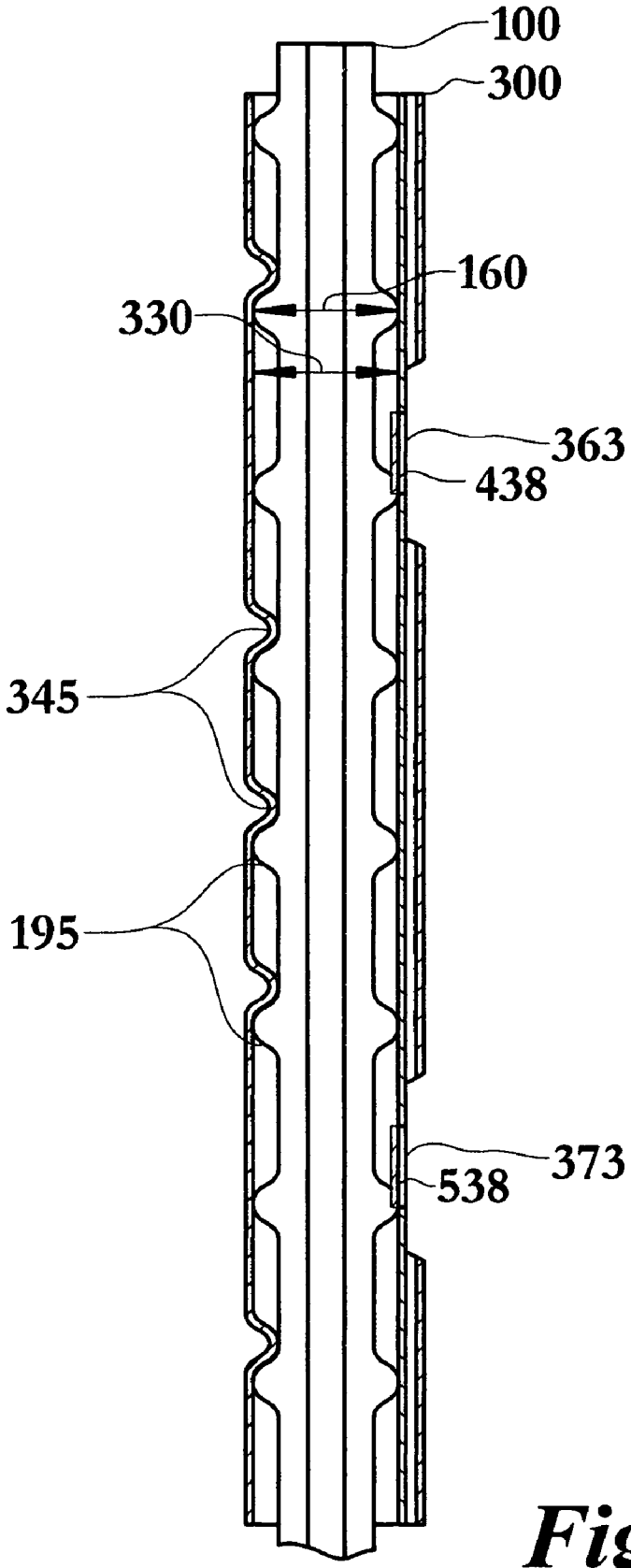
FIG. 45 shows the cross-sectional view of FIG. 43 combined with the elevation view of FIG. 44, not to scale.

The fence post sleeve interior minimum cross-sectional width (330) and the post maximum cross-sectional width (160) cooperate to releasably couple the fence post sleeve (300) to the fence post (100) by insertion of the post sleeve (300) onto the fence post (100), as seen in FIG. 45. In one embodiment, the fence post sleeve longitudinal slit (380) may have a positive distance between the longitudinal slit left edge (382) and the longitudinal slit right edge (383), resulting in a gap between the longitudinal slit left edge (382) and the longitudinal slit right edge (383), as seen in FIG. 38. In this embodiment, the post sleeve (300) can be compressively attached to a fence post (100) having a large diameter or alternatively be held in place by the weight of the fence post sleeve (300) and flexible barrier fencing (600).

Figure 39:
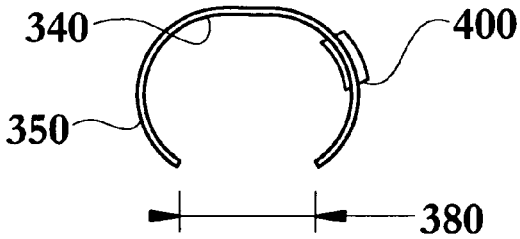
FIG. 39 shows a top plan view of an embodiment of the fence post sleeve, having a fence post sleeve longitudinal slit with a positive distance between the longitudinal slit left edge and the longitudinal slit right edge, not to scale.

In some instances, the fence post (100) may be too tall or may have an attachment on the top end that prevents the fence post sleeve from being slid onto the fence post (100). In these instances, the sleeve interior minimum cross-sectional width (330) can be extended, as seen in FIG. 39. By extending the sleeve interior minimum cross-sectional width (330), the fence post sleeve (300) can be wrapped around the fence instead of having to be slid on.

Figure 40:
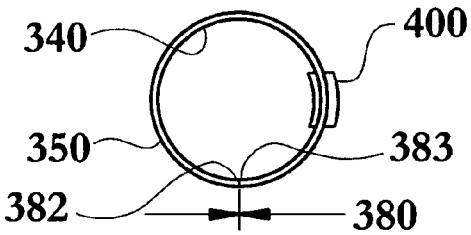
FIG. 40 shows a top plan view of an embodiment of the fence post sleeve, having a fence post sleeve longitudinal slit with neutral distance between the longitudinal slit left edge and the longitudinal slit right edge, not to scale.

In another embodiment there may be neutral distance between the longitudinal slit left edge (382) and the longitudinal slit right edge (383), as seen in FIG. 40. In this embodiment the fence post sleeve (300) is held in place by the weight of the fence post sleeve (300) and flexible barrier fencing (600).

Figure 41:
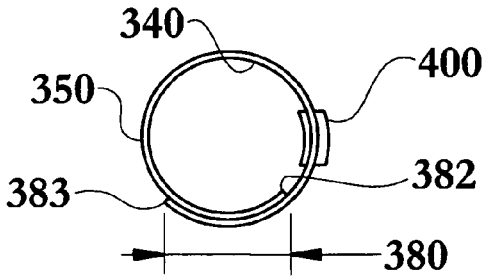
FIG. 41 shows a top plan view of an embodiment of the fence post sleeve, having a fence post sleeve longitudinal slit with negative distance between the longitudinal slit left edge and the longitudinal slit right edge, not to scale.

In yet another embodiment there may be a negative distance between the longitudinal slit left edge (382) and the longitudinal slit right edge (383), causing the longitudinal slit left edge (382) and longitudinal slit right edge (383) to overlap, as seen in FIG. 41. In this embodiment, fence post sleeve interior minimum cross-sectional width (330) is slightly smaller than the post maximum cross-sectional width (160). As a result, the post sleeve (300) has a is held in place by fiction due to a close compression fit between the fence post sleeve (300) and the fence post (100).

In another configuration, the fence post sleeve (300) may have a larger fence post sleeve interior minimum cross-sectional width (330) at the fence post sleeve proximal end (306) than at the fence post sleeve distal end (305), creating a greater compression force at the post bottom end (140) than at the post top end (120) by tapering the fence post sleeve (300).

Figure 15:
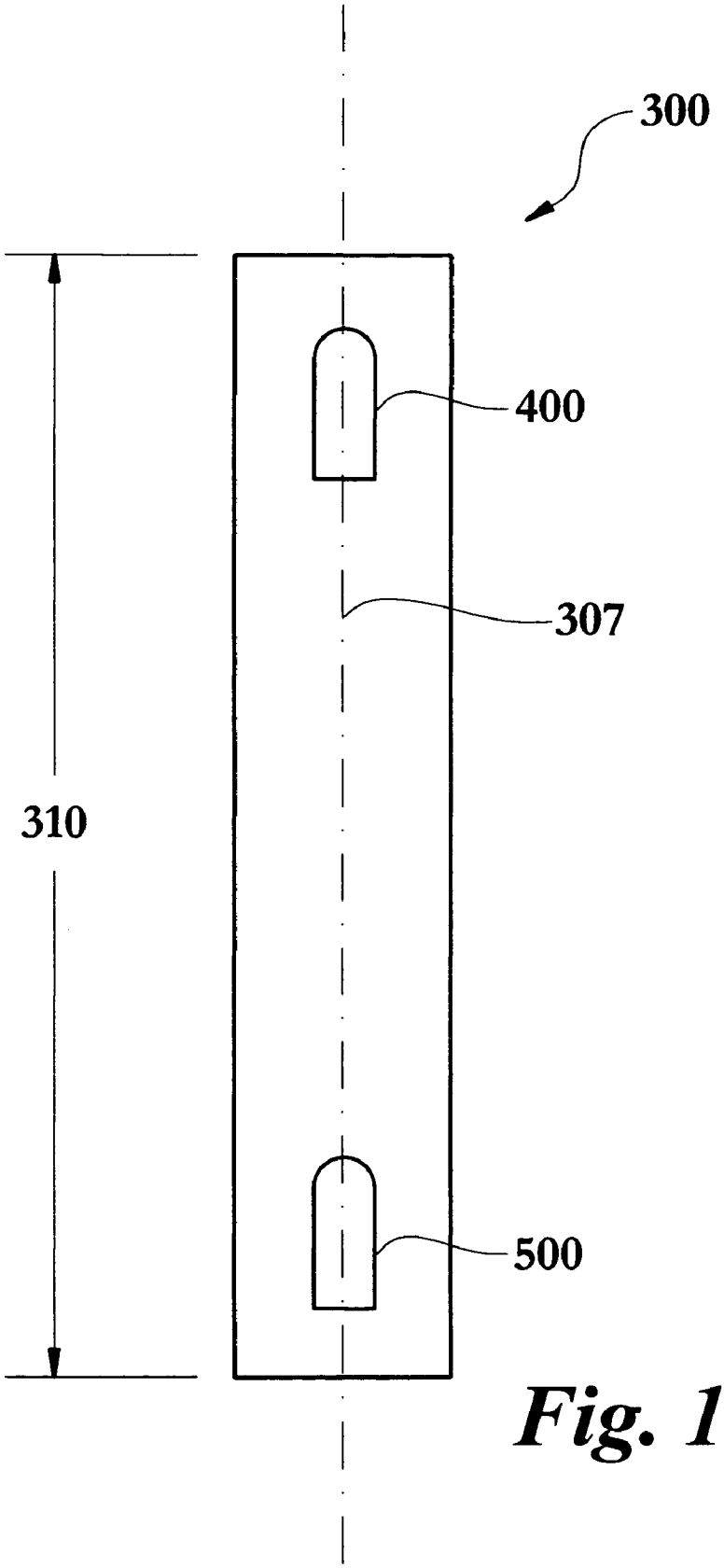
FIG. 15 shows a front elevation view of an embodiment of the post sleeve of the present invention with the top and bottom barrier fence clips oriented substantially parallel to the fence post sleeve central axis, not to scale.
Figure 16:
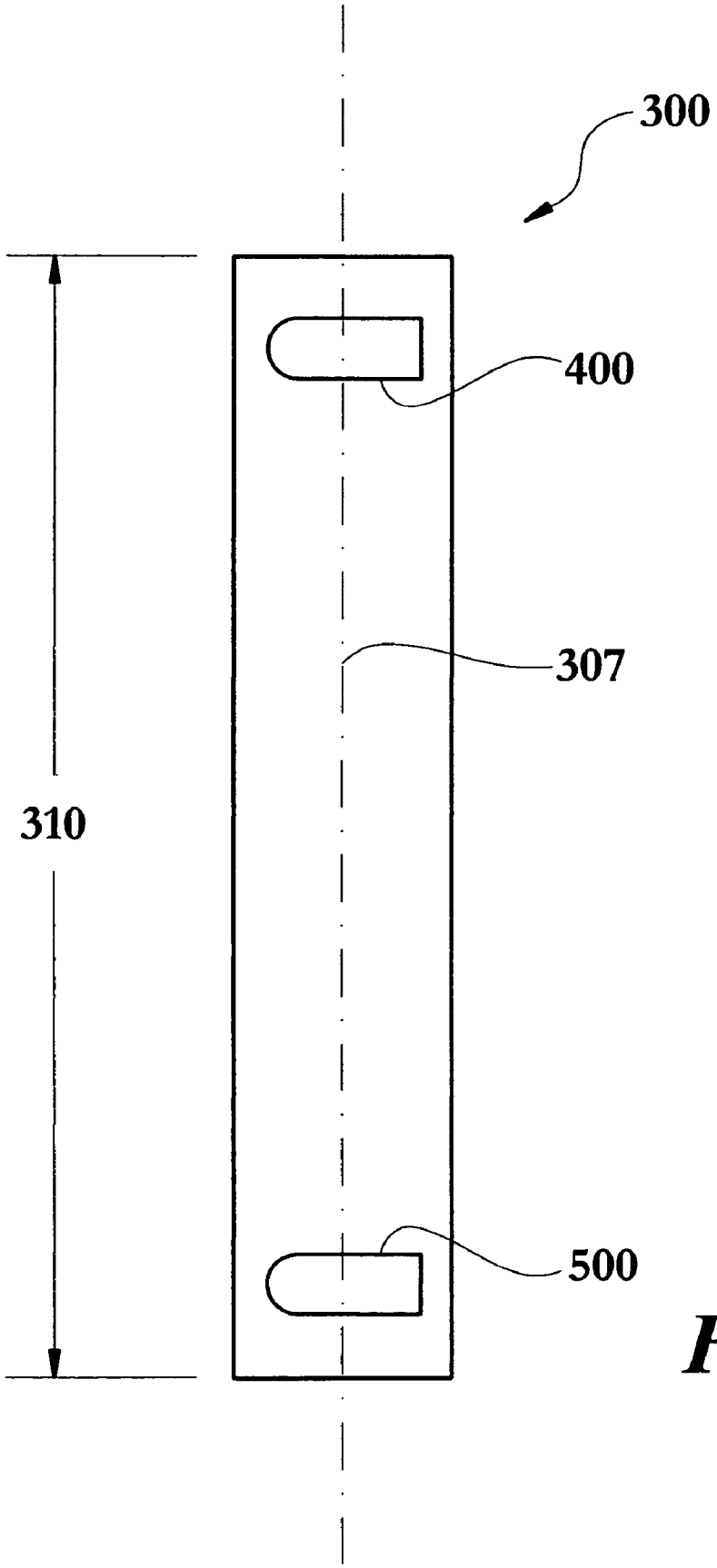
FIG. 16 shows a front elevation view of an embodiment of the post sleeve of the present invention with the top and bottom barrier fence clips oriented orthogonal to the fence post sleeve central axis, not to scale.
Figure 42:
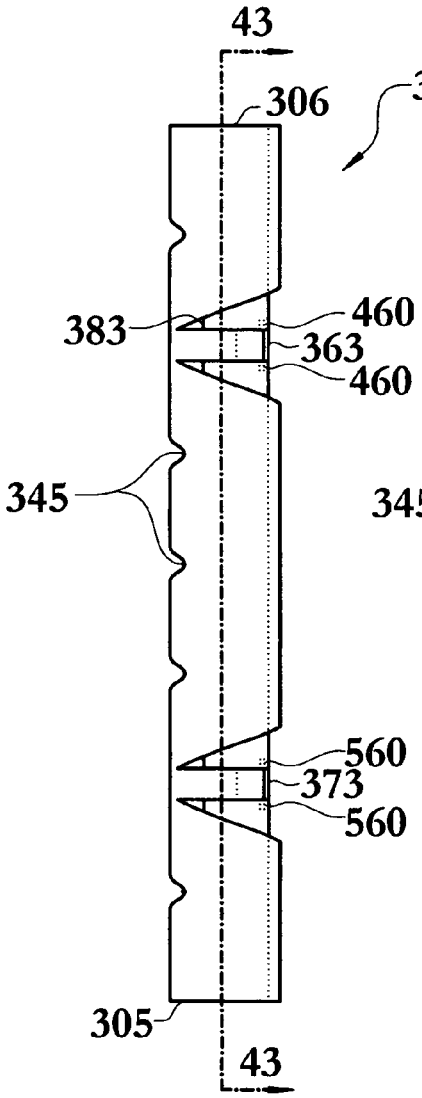
FIG. 42 shows a front elevation view of an embodiment of the flexible barrier fencing having sleeve interior surface gripping projections, not to scale.
Figure 43:
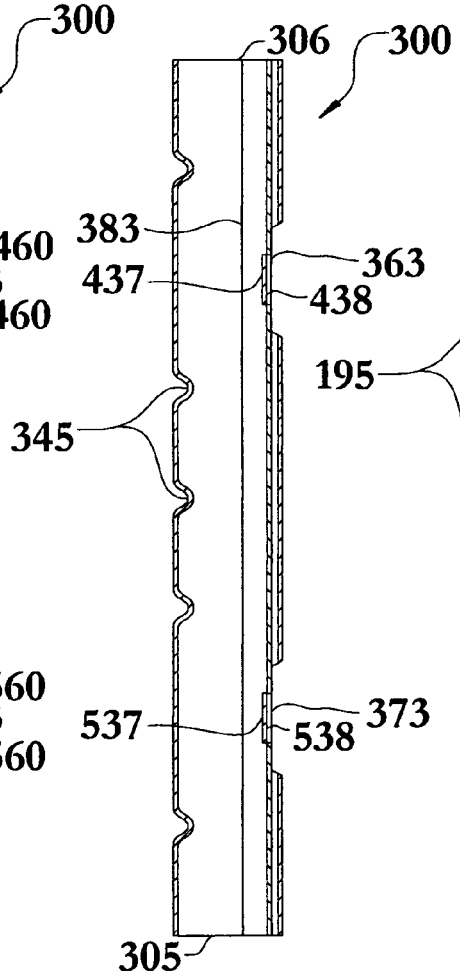
FIG. 43 shows a cross-sectional view taken along section line 43-43 of FIG. 42.
Figure 44:
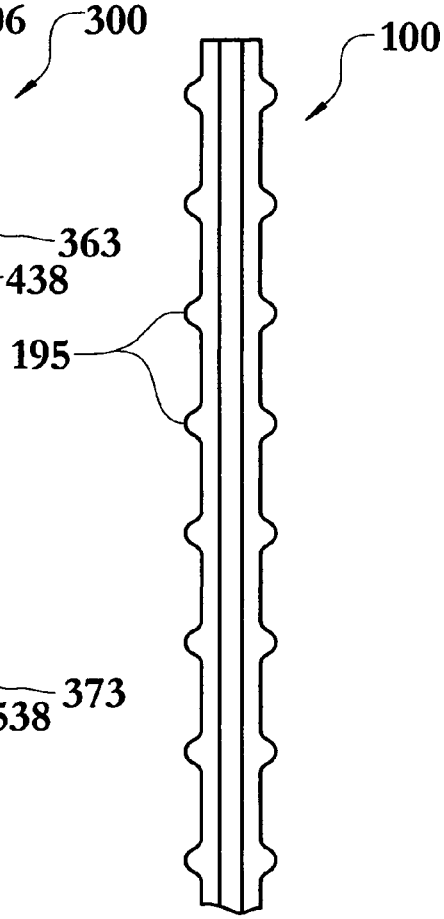
FIG. 44 shows a front elevation view of an embodiment of the fence post having post exterior surface gripping extensions, not to scale.

Many commercial fence posts have post surface gripping extensions (195) formed on the post exterior surface (190) that serve as point(s) upon which the wire ties holding the flexible barrier fencing (600) to the fence post (100) may grip. As one skilled in the art will appreciate, the fence post sleeve (300) can be held, vertically secure on the fence post (100) by a plurality of sleeve interior surface gripping projections (345) that cooperate with the plurality of post surface gripping extensions (195), as seen in FIG. 45. FIG. 42 shows a front elevation view of an embodiment of the flexible barrier fencing having sleeve interior surface gripping projections. FIG. 43 shows a cross-sectional view taken along section line 43-43 of FIG. 42. The fence post exterior gripping extensions are illustrated in FIG. 44. In one variation of the fence post sleeve (300), the top barrier fence clip (400) is oriented substantially parallel to the fence post sleeve central axis (307), and the bottom barrier fence clip (500) is oriented substantially parallel to the fence post sleeve central axis (307), as seen in FIG. 15. In another variation, the top barrier fence clip (400) is oriented substantially orthogonal to the fence post sleeve central axis (307), and the bottom barrier fence clip (500) is oriented substantially orthogonal to the fence post sleeve central axis (307), as seen in FIG. 16.

Figure 34:
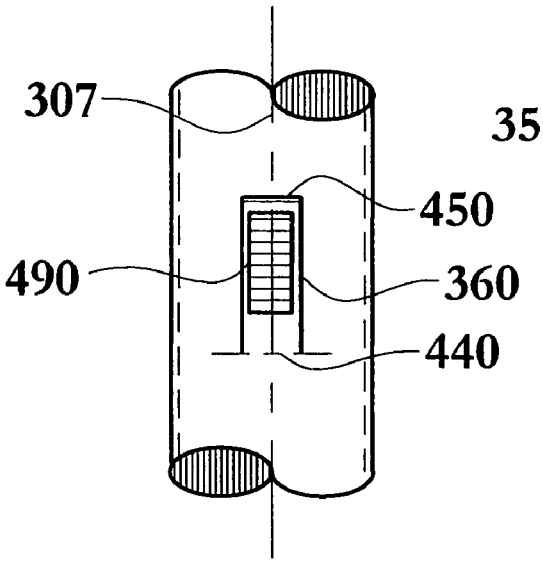
FIG. 34 shows a partial front elevation view of an embodiment of the fence post sleeve of the present invention with the top barrier fence clip having a top clip securing clip serrated thumb portion, not to scale.
Figure 35:
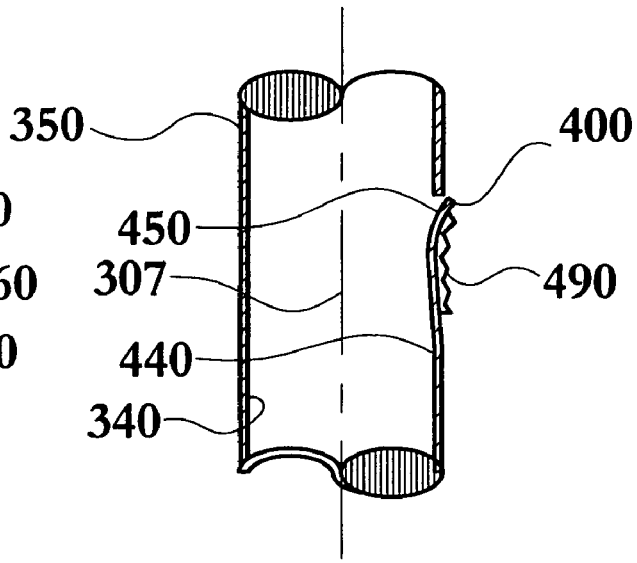
FIG. 35 shows a partial cross-sectional view of the embodiment of FIG. 34, not to scale.
Figure 36:
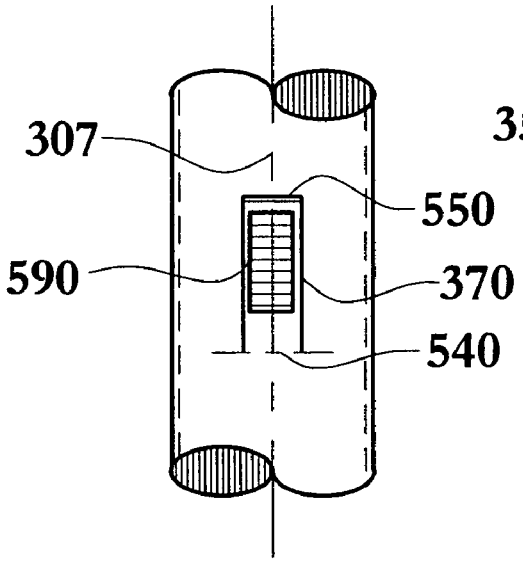
FIG. 36 shows a partial front elevation view of an embodiment of the fence post sleeve of the present invention with the bottom barrier fence clip having a top clip securing clip serrated thumb portion, not to scale.
Figure 37:
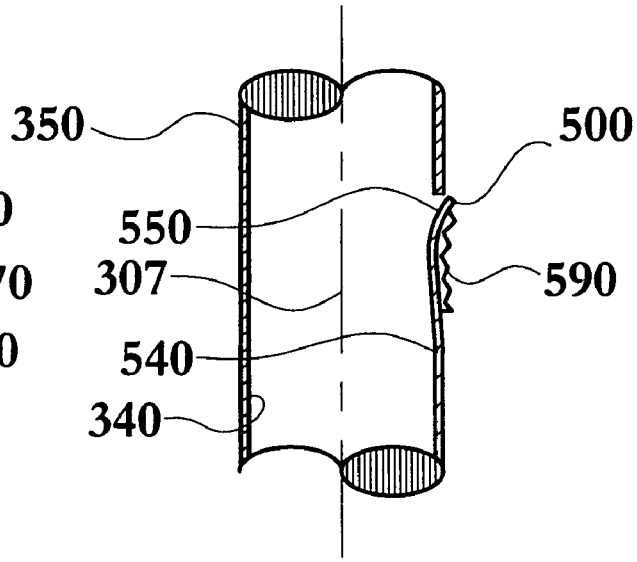
FIG. 37 shows a partial cross-sectional view of the embodiment of FIG. 36, not to scale.

In another configuration, the top barrier fence clip (400) has a top clip securing clip serrated thumb portion (490), and the bottom barrier fence clip (500) has a bottom clip securing clip serrated thumb portion (590) that provides a frictional surface to prevent slippage when being pressed, illustrated in FIGS. 34-37. FIG. 34 shows a partial front elevation view of an embodiment of the fence post sleeve of the present invention with the top barrier fence clip having a top clip securing clip serrated thumb portion. Whereas, FIG. 35 shows a partial cross-sectional view of the top barrier fence clip (500) with the top clip securing clip serrated thumb portion (590). Similarly, FIG. 36 shows a partial front elevation view of an embodiment of the fence post sleeve of the present invention with the bottom barrier fence clip having a bottom clip securing clip serrated thumb portion. Whereas, FIG. 37 shows a partial cross-sectional view of the bottom barrier fence clip (500) with the top clip securing clip serrated thumb portion (590). Any friction enhancing feature may be, used to prevent slippage. Some options of friction enhancing features include, but not limited to, are barrier fence clip surfaces coated with epoxy bonded sand, anti-slip rubber pads, and pitted surfaces.

In one embodiment of the fence post sleeve (300), the top barrier fence clip (400) and the bottom barrier fence clip (500) project from the longitudinal slit left edge (382), as seen in FIG. 6. In another embodiment seen in FIG. 7, the top barrier fence clip (400) is located within a top longitudinal slit clip recess (384) and a portion of the top longitudinal slit clip recess (384) is in contact with the longitudinal slit left edge (382). In the same embodiment, the bottom barrier fence clip (500) is located within a bottom longitudinal slit clip recess (385) and a portion of the bottom longitudinal slit clip recess (385) is in contact with the longitudinal slit left edge (382). In yet another embodiment, the top clip insertion edge (450), and the bottom clip insertion edge (550) do not extend past the longitudinal slit left edge (382).

Figure 5:
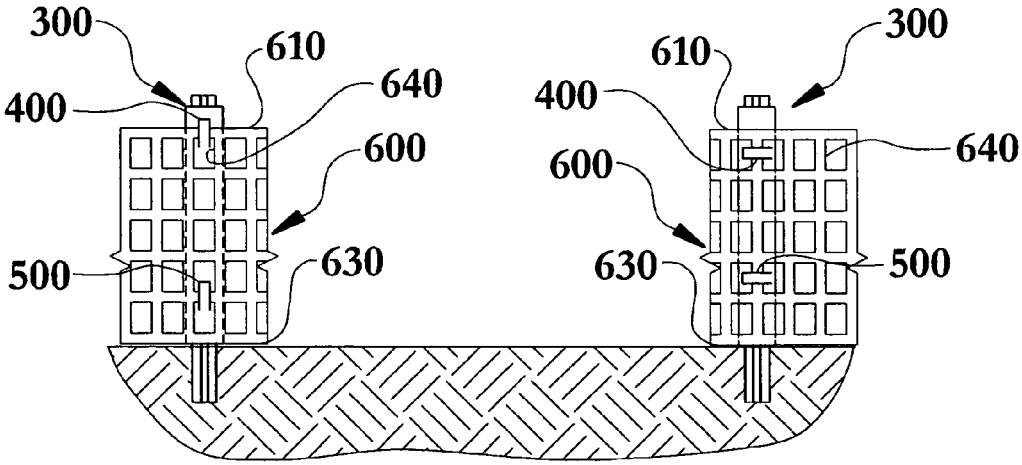
FIG. 5 shows a front elevation view of an embodiment of the fence post sleeve attached to a post with the flexible barrier attached to the fence post sleeve, not to scale.

The top clip location (405) and the top clip length (420) are designed to cooperate with one of the plurality of openings (640) and releasably secure the flexible barrier fencing (600) between the fence post sleeve exterior surface (350) and the top barrier fence clip interior surface (437). Furthermore, the bottom clip location (505) and the bottom clip length (520) are also designed to cooperate with one of the plurality of openings (640) and releasably secure the flexible barrier fencing (600) between the fence post sleeve exterior surface (350) and the bottom barrier fence clip interior surface (537), as illustrated in FIG. 5.

Figure 21:
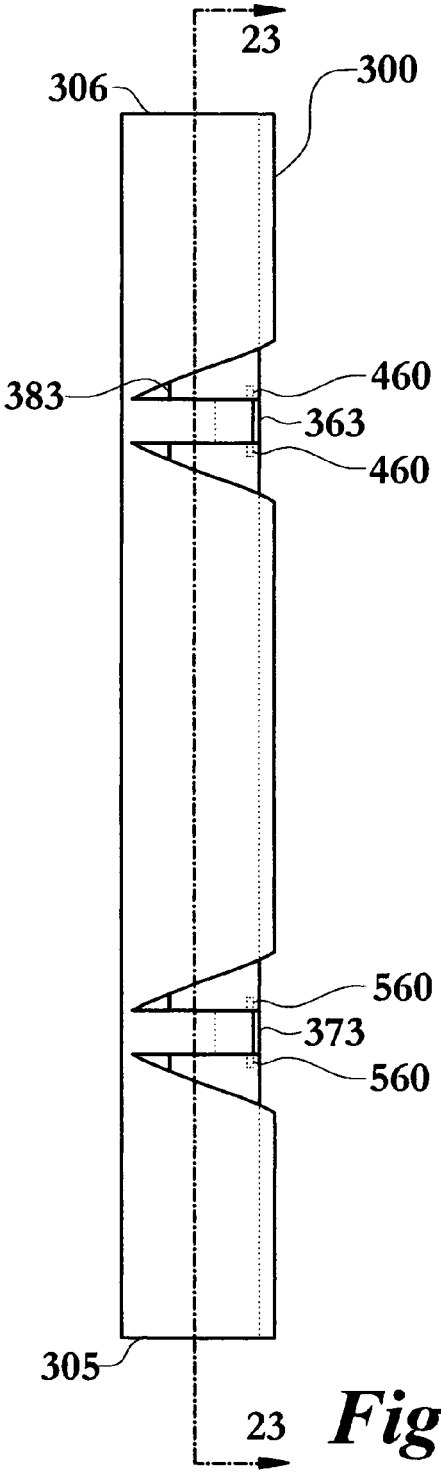
FIG. 21 shows a front elevation view of an embodiment of the fence post sleeve of the present invention with the top and bottom barrier fence clips oriented orthogonal to the fence post sleeve central axis and the top and bottom barrier fence clips utilize clip insertion edge barbs, and are located in longitudinal clip recesses, not to scale.
Figure 22:
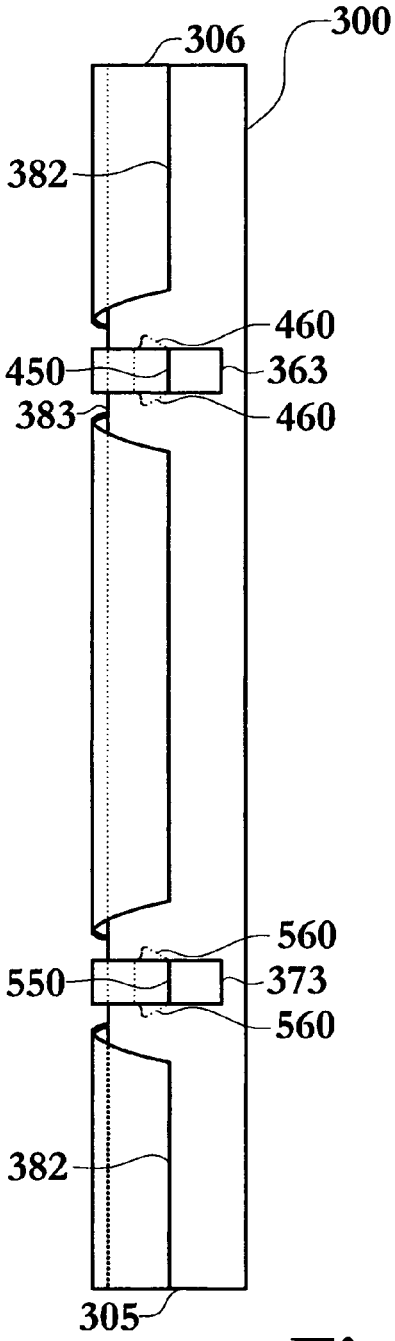
FIG. 22 shows a side elevation view of the embodiment of FIG. 21, not to scale.

In another embodiment of the fence post sleeve (300), seen in FIGS. 7, 21, and 22, the top clip insertion edge (450) is shaped to form a top clip insertion edge barb (460) having a top clip insertion edge barb width (470). In this embodiment, the top clip insertion edge barb width (470) is greater than the top clip receiving slot width (364), and the top clip width (430) is less than the top clip receiving slot width (364), such that the top barrier fence clip (400) must be twisted to permit the top clip insertion edge barb (460) to pass through the top clip receiving slot (360) and engage the fence post sleeve interior surface (340) when allowed to return to a top clip natural position (410). Similarly, the bottom clip insertion edge (550) may be shaped to form a bottom clip insertion edge barb (560) having a bottom clip insertion edge barb width (570). Furthermore, the bottom clip insertion edge barb width (570) is greater than the bottom clip receiving slot width (374), and the bottom clip width (530) is less than the bottom clip receiving slot width (374), such that the bottom barrier fence clip (500) must be twisted to permit the bottom clip insertion edge barb (560) to pass through the bottom clip receiving slot (370) and engage the fence post sleeve interior surface (340) when allowed to return to a bottom clip natural position (510), as illustrated in FIG. 7. In this embodiment, when the wind blows against the flexible barrier fencing it causes the fence post sleeve (300) to tighten around the post and become more secure.

In another configuration, seen in FIG. 8, the top clip insertion edge (450) is shaped to form a top clip insertion edge barb (460) having a top clip insertion edge barb width (470). In this configuration, the top clip receiving slot (360) has a top clip receiving slot insertion slot (368) having a top clip receiving slot insertion slot width (369) located substantially orthogonal to the top clip receiving slot dextral edge (363). In addition, the top clip insertion edge barb width (470) is greater than the top clip receiving slot width (364) and less than the top clip receiving slot insertion slot width (369), and the top clip width (430) is less than the top clip receiving slot width (364). When the top clip insertion barb (460) is passed through the top clip receiving slot insertion slot (368) the top clip insertion barb (460) engages the fence post sleeve interior surface (340). In the same configuration, the bottom clip insertion edge (550) is shaped to form a bottom clip insertion edge barb (560) having a bottom clip insertion edge barb width (570). The bottom clip receiving slot has a bottom clip receiving slot insertion slot (378) having a bottom clip receiving slot insertion slot width (379) located substantially orthogonal to the bottom clip receiving slot dextral edge (374). In addition, the bottom clip insertion edge barb width (570) is greater than the bottom clip receiving slot width (374) and less than the bottom clip receiving slot insertion slot width (379), and the bottom clip width (530) is less than the bottom clip receiving slot width (374). When the bottom clip insertion barb (560) is passed through the bottom clip receiving slot insertion slot (378) the bottom clip insertion barb (560) engages the fence post sleeve interior surface (340). Like the preceding embodiment, when the wind blows against the flexible barrier fencing it causes the fence post sleeve (300) to tighten around the post and become more secure.

Figure 17:
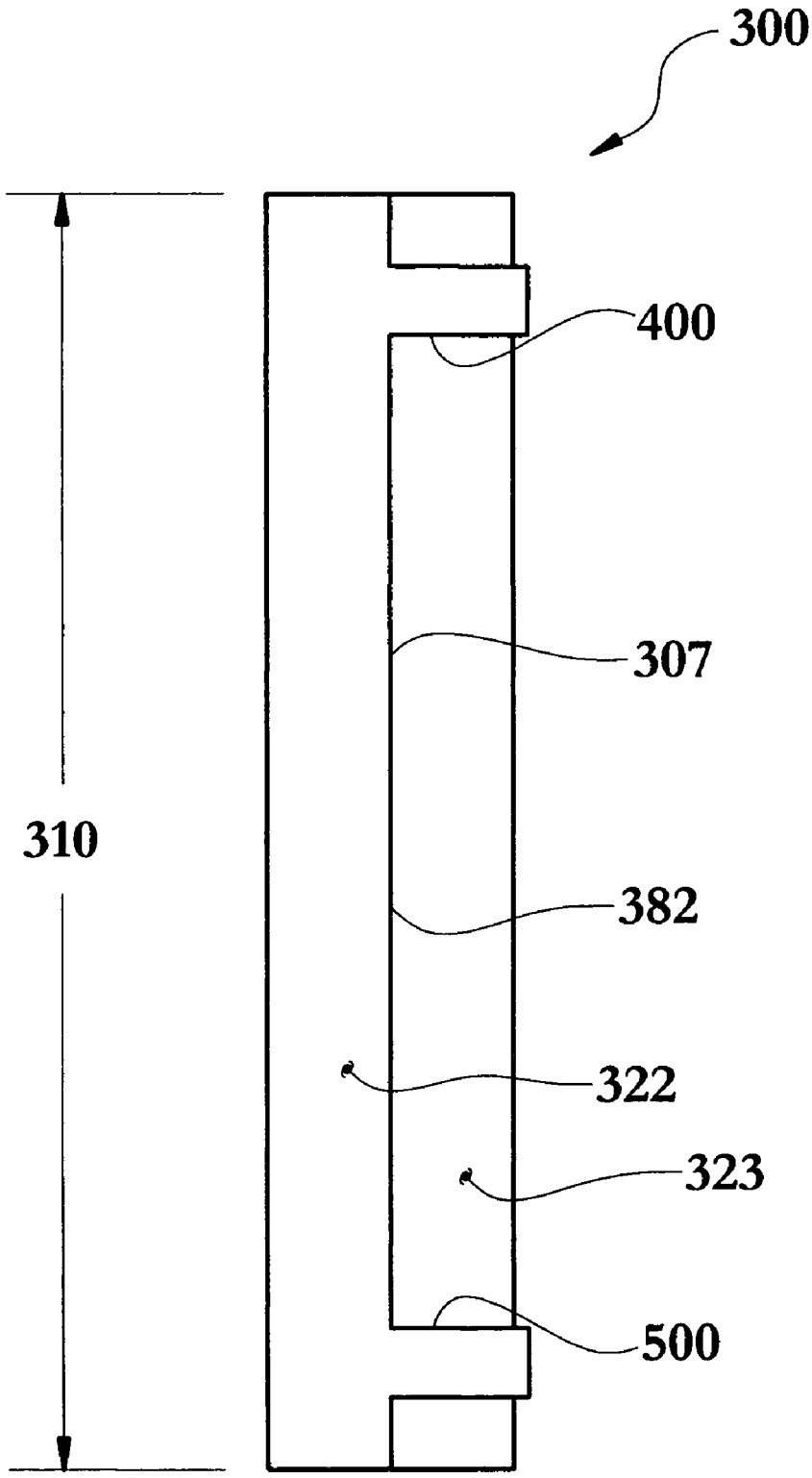
FIG. 17 shows a side elevation view of an embodiment of the post sleeve of the present invention with the top and bottom barrier fence clips oriented orthogonal to the fence post sleeve central axis and where the top and bottom barrier fence clips compressively cooperate with the with the right sleeve portion, not to scale.
Figure 18:
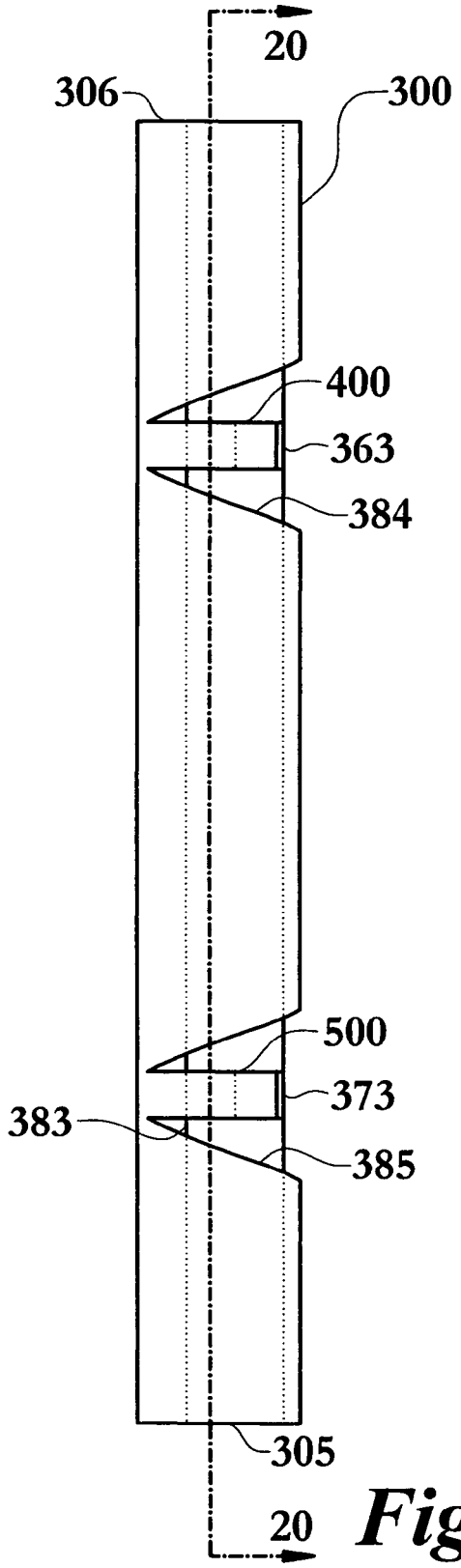
FIG. 18 shows a front elevation view of an embodiment of the post sleeve of the present invention with the top and bottom barrier fence clips oriented orthogonal to the fence post sleeve central axis and the top and bottom barrier fence clips are located in longitudinal clip recesses, not to scale.
Figure 19:
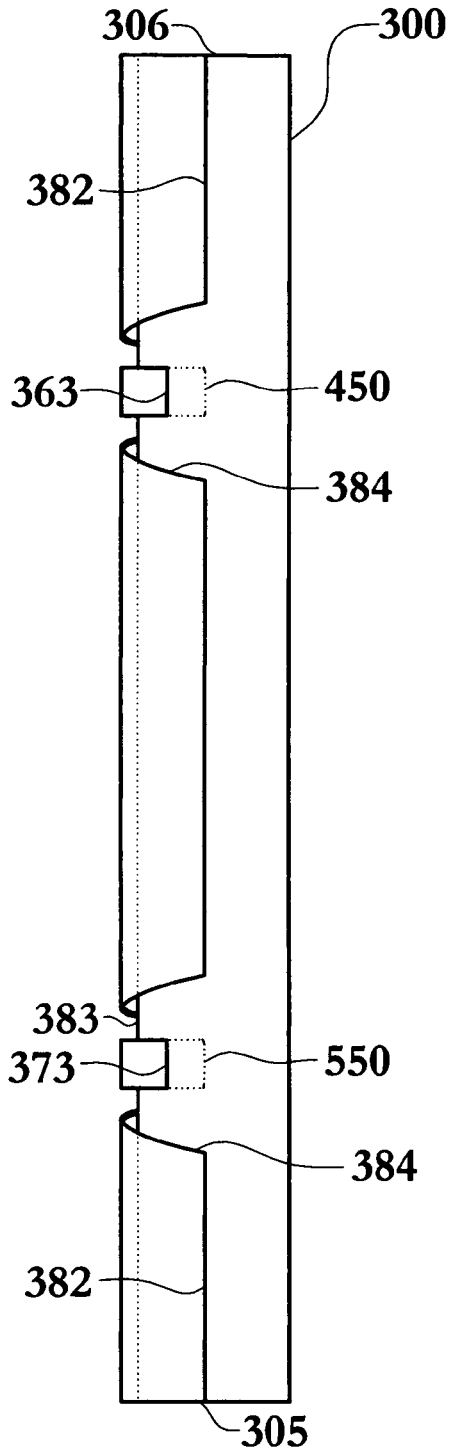
FIG. 19 shows a side elevation view of the embodiment of FIG. 18, not to scale.
Figure 20:
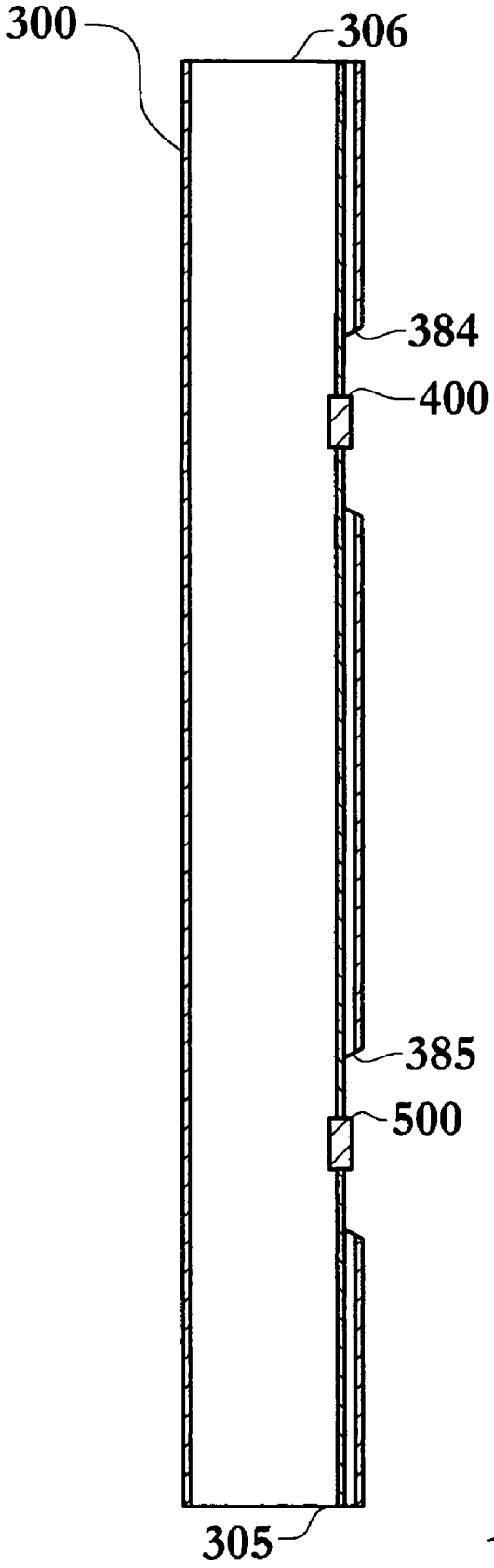
FIG. 20 shows a cross-sectional view taken along section line 20-20 of FIG. 18, not to scale.

In another embodiment, the top barrier fence clip (400) and the bottom barrier fence clip (500) compressively cooperate with the right sleeve portion (323), as seen in FIG. 17. In yet another embodiment, in the top barrier fence clip (400) releasably cooperates with a top clip receiving slot (360) formed in the fence post sleeve (300), which has a top clip receiving slot sinistral edge (362) and a top clip receiving slot dextral edge (363), and a top clip receiving slot width (364) defined by the distance between a top clip receiving slot proximal edge (365) and a top clip receiving slot distal edge (366). In addition, the top clip receiving slot (360) is located within the right sleeve portion (323), and the top barrier fence clip (400) is attached to the left sleeve portion (322). In the same embodiment, the bottom barrier fence clip (500) releasably cooperates with a bottom clip receiving slot (370) formed in the fence post sleeve (300) which has a bottom clip receiving slot sinistral edge (372) and a bottom clip receiving slot dextral edge (373), and a bottom clip receiving slot width (374) defined by the distance between a bottom clip receiving slot proximal edge (375) and a bottom clip receiving slot distal edge (376). As seen in FIGS. 18-20, the bottom clip receiving slot (370) is located within the right sleeve portion (323) and the bottom barrier fence clip (500) is attached to the left sleeve portion (322).

In another configuration, the top barrier fence clip (400) is located in a top clip receiving slot (360), and the bottom barrier fence clip (500) is located in a bottom clip receiving slot (370), as illustrated in FIG. 12.

Figure 24:
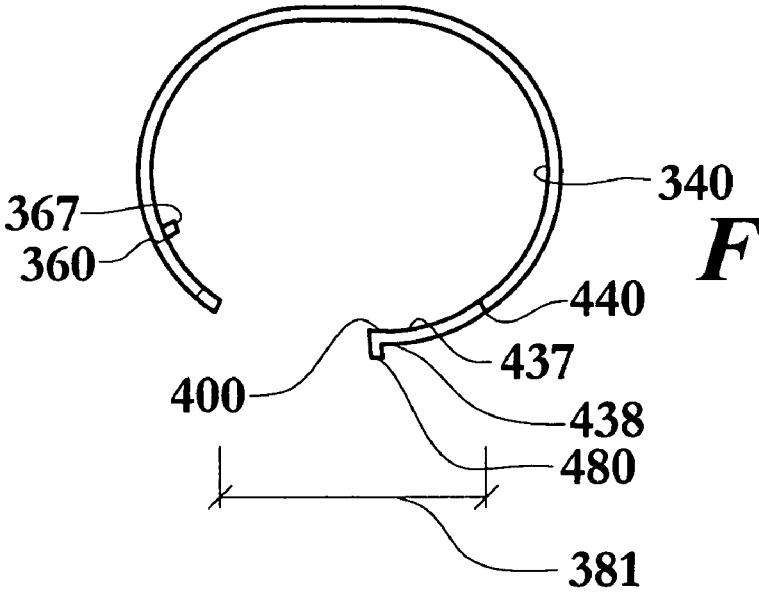
FIG. 24 shows a top plan view of an embodiment of the fence post sleeve, with the top barrier fence clips oriented orthogonal to the fence post sleeve central axis, having a top clip receiving slot shelf, and a top clip securing ledge, in the open, unlatched state, not to scale.
Figure 25:
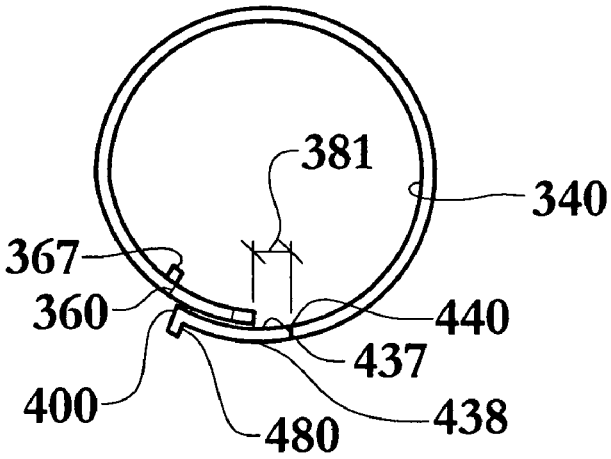
FIG. 25 shows a top plan view of an embodiment of the fence post sleeve, with the top barrier fence clips oriented orthogonal to the fence post sleeve central axis, having a top clip receiving slot shelf, and a top clip securing ledge, in a closed, unlatched state, not to scale.
Figure 26:
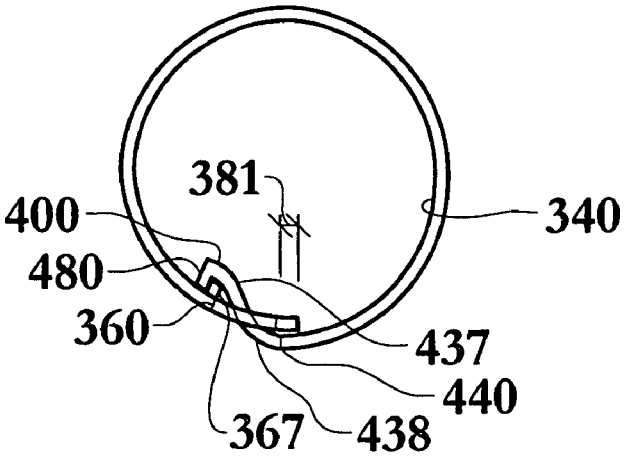
FIG. 26 shows a top plan view of an embodiment of the fence post sleeve, with the top barrier fence clips oriented orthogonal to the fence post sleeve central axis, having a top clip receiving slot shelf, and a top clip securing ledge, in a closed, latched state, not to scale.
Figure 27:
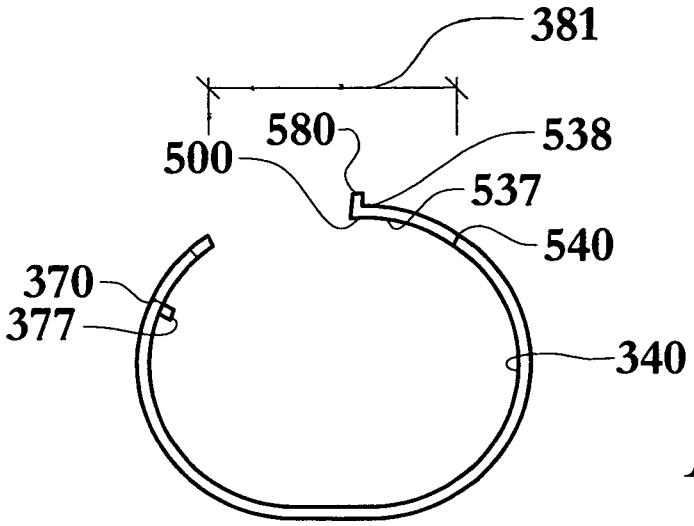
FIG. 27 shows a bottom plan view of an embodiment of the fence post sleeve, with the bottom barrier fence clips oriented orthogonal to the fence post sleeve central axis, having a bottom clip receiving slot shelf, and a bottom clip securing ledge, in the open, unlatched state, not to scale.
Figure 28:
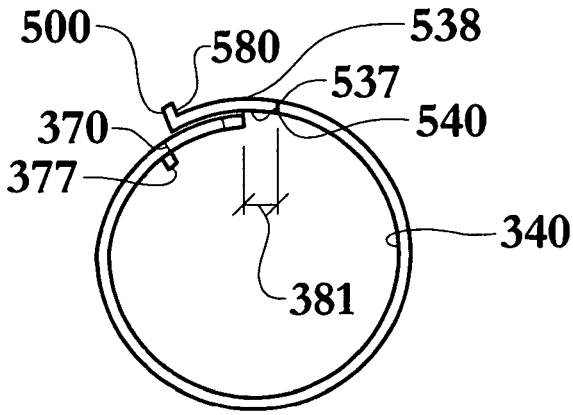
FIG. 28 shows a bottom plan view of an embodiment of the fence post sleeve, with the bottom barrier fence clips oriented orthogonal to the fence post sleeve central axis, a bottom clip receiving slot shelf, and a bottom clip securing ledge, in the closed, unlatched state, not to scale.
Figure 29:
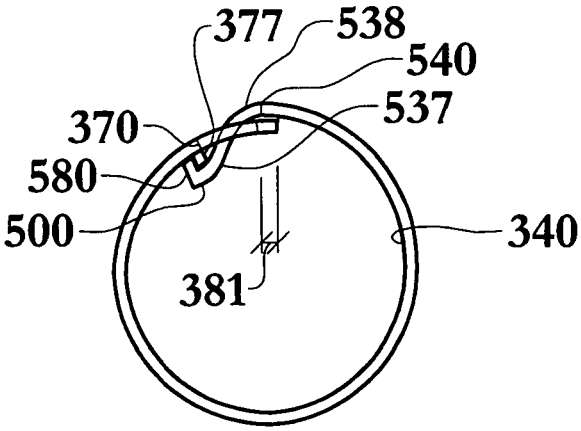
FIG. 29 shows a bottom plan view of an embodiment of the fence post sleeve, with the bottom barrier fence clips oriented orthogonal to the fence post sleeve central axis, having a bottom clip receiving slot shelf, and a bottom clip securing ledge, in the closed, latched state, not to scale.
Figure 30:
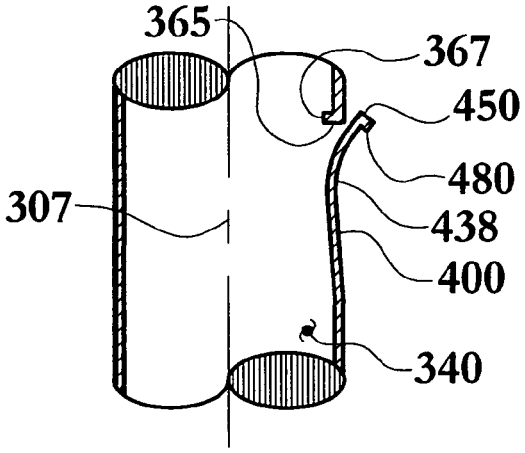
FIG. 30 shows a partial cross-sectional view of an embodiment of the fence post sleeve with the top barrier fence clips oriented substantially parallel to the fence post sleeve central axis, that utilizes a top clip receiving slot shelf, and a top clip securing ledge, in the unlatched state, not to scale.
Figure 31:
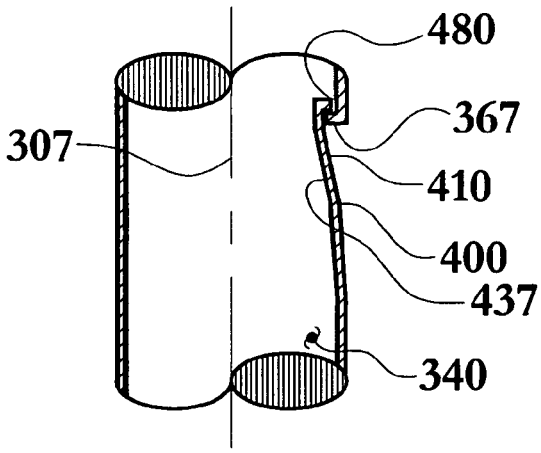
FIG. 31 shows a partial cross-sectional view of an embodiment of the fence post sleeve with the top barrier fence clips oriented substantially parallel to the fence post sleeve central axis, that utilizes a top clip receiving slot shelf, and a top clip securing ledge, in the latched state, not to scale.
Figure 32:
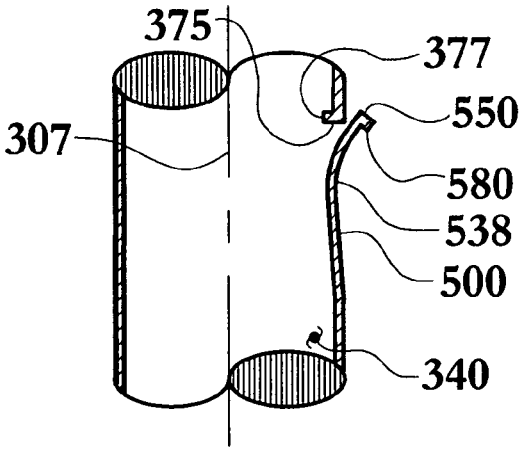
FIG. 32 shows a partial cross-sectional view of an embodiment of the fence post sleeve with the bottom barrier fence clips oriented substantially parallel to the fence post sleeve central axis, that utilizes a bottom clip receiving slot shelf, and a bottom clip securing ledge, in the unlatched state, not to scale.
Figure 33:
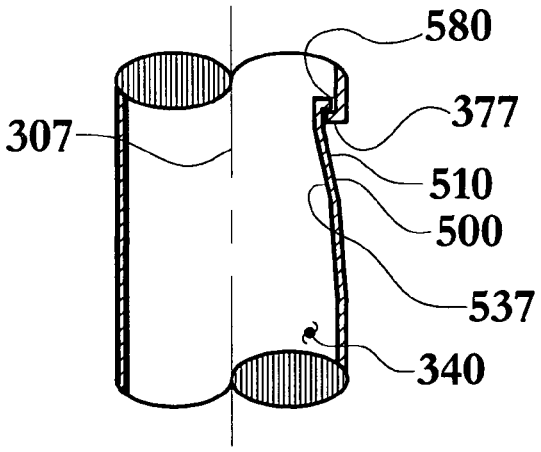
FIG. 33 shows a partial cross-sectional view of an embodiment of the fence post sleeve with the bottom barrier fence clips oriented substantially parallel to the fence post sleeve central axis, that utilizes a bottom clip receiving slot shelf, and a bottom clip securing ledge, in the latched state, not to scale.

In another embodiment of the fence post sleeve (300), seen in FIG. 24, the top barrier fence clip (400) has a top clip securing ledge (480) located on the top clip exterior surface (438), and the top clip receiving slot (360) has a top clip receiving slot shelf (367) located on the fence post sleeve interior surface (340). The top clip securing ledge (480) cooperates with the top clip receiving slot shelf (367) when the top barrier fence clip (400) is inserted through the top clip receiving slot (360). FIG. 25 illustrates the top barrier fence clip (400) in a closed, unlocked position. FIG. 26 illustrates the top barrier fence clip (400) in a closed, unlocked position. In the same embodiment of fence post sleeve (300), seen in FIG. 27, the bottom barrier fence clip (500) has a bottom clip securing ledge (580) located on the bottom clip exterior surface (538), and the bottom clip receiving slot (370) has a bottom clip receiving slot shelf (377) located on the fence post sleeve interior surface (340). The bottom clip securing ledge (580) cooperates with the bottom clip receiving slot shelf (377) when the bottom barrier fence clip (500) is inserted through the bottom clip receiving slot (370). FIG. 28 illustrates the bottom barrier fence clip (400) in a closed, unlocked position. FIG. 29 illustrates the bottom barrier fence clip (400) in a closed, unlocked position. The configuration of the top clip securing ledge (480), the bottom clip securing ledge (580), top clip receiving slot shelf (367), and the bottom clip receiving slot shelf (377) may be shaped in any number of interconnection shapes and is not limited to that shown in the figures. FIG. 30 illustrates the top barrier fence clip (400) which is substantially parallel to the fence post sleeve central axis (307) and is unlatched. FIG. 31 illustrates the top barrier fence clip (400) which is substantially parallel to the fence post sleeve central axis (307) and is latched. Similarly, FIG. 32 shows a bottom barrier fence clip (500) that is substantially parallel to the fence post sleeve central axis (307) and unlatched. FIG. 33 shows a bottom barrier fence clip (500) that is substantially parallel to the fence post sleeve central axis (307) and is latched. The top barrier fence clip (400) and the bottom barrier fence clip (500) rigidity may be enhanced by increasing the clip thickness at the top clip insertion edge (450) and the bottom clip insertion edge (550), or by including a reinforcing ridge along the top clip length (420) and bottom clip length (520).

As one with skill in the art will appreciate, although the fence post sleeve (300) shape is shown a circular, it may be square, rectangular, triangular, or any other shape that facilitates cooperation with the fence post (100).

In order to construct the fencing system, the fence posts (100) are anchored in the ground or otherwise secured, revealed in FIGS. 4 and 5. Next, the fence post sleeve (300) is releasably coupled with the fence post (100). Finally, the flexible barrier fencing (600) is releasably connected to the fence post sleeve (300) by using the barrier fence clips (400, 500) to create the temporary fencing system illustrated by FIG. 5.

One with skill in the art will appreciate that the post sleeve (300) of the present invention will work well with posts having any cross-sectional geometry and is not limited to the post shapes illustrated in FIGS. 1, 2, 44, and 45. Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A fence mounting device, designed to be releasably attached to a fence post (100) having a post exterior surface (190), a post bottom end (140) and a post top end (120), wherein the distance between the post bottom end (140) and the post top end (120) defines a post length (180), and the fence post (100) has a post maximum cross-sectional width (160), wherein the fence mounting device to releasably secures a flexible barrier fencing (600), having a plurality of openings (640), a top edge (610), a bottom edge (630), and a height (620), to the fence post (100), the mounting device comprising:

a fence post sleeve (300) having:

(a) a fence post sleeve distal end (305) and a fence post sleeve proximal end (306), wherein the distance between the fence post sleeve distal end (305) and the fence post sleeve proximal end (306) defines a fence post sleeve length (310) having a fence post sleeve length midpoint (311) substantially equidistant from the fence post sleeve distal end (305) and the fence post sleeve proximal end (306);

(b) a fence post sleeve longitudinal slit (380), extending from the fence post sleeve distal end (305) to the fence post sleeve proximal end (306), having a fence post sleeve longitudinal slit separation distance (381), with a longitudinal slit left edge (382) and a longitudinal slit right edge (383);

(c) a fence post sleeve width (320) and a fence post sleeve width midpoint (321) substantially equidistant from the longitudinal slit left edge (382) and the longitudinal slit right edge (383);

(d) a left sleeve portion (322) extending from the longitudinal slit left edge (382) to the fence post sleeve width midpoint (321) and bounded by the fence post sleeve distal end (305) and the fence post sleeve proximal end (306);

(e) a right sleeve portion (323) extending from the longitudinal slit right edge (383) to the fence post sleeve width midpoint (321) and bounded by the fence post sleeve distal end (305) and the fence post sleeve proximal end (306);

(f) a fence post sleeve interior surface (340), an interior minimum cross-sectional width (330), and a fence post sleeve exterior surface (350);

(g) a fence post sleeve central axis (307), substantially parallel to the fence post sleeve longitudinal slit (380) extending from the fence post sleeve distal end (305) to the fence post sleeve proximal end (306) and positioned at a midpoint of the interior minimum cross-sectional width (330);

(h) at least one top barrier fence clip (400) at a top clip location (405) between the fence post sleeve length midpoint (311) and the fence post sleeve proximal end (306), and at least one bottom barrier fence clip (500) at a bottom clip location (505) between the fence post sleeve length midpoint (311) and the fence post sleeve distal end (305) wherein;

(i) the top barrier fence clip (400) is oriented substantially orthogonal to the fence post sleeve central axis (307) and has a top clip attachment edge (440) and a top clip insertion edge (450), and the bottom barrier fence clip (500) is oriented substantially orthogonal to the fence post sleeve central axis (307) and has a bottom clip attachment edge (540) and a bottom clip insertion edge (550);

(ii) the top barrier fence clip (400) has a top clip length (420), defined by the distance between the top clip attachment edge (440) and the top clip insertion edge (450), and a top clip width (430), defined by the distance between a top clip proximal edge (435) and a top clip distal edge (436), and a top clip interior surface (437), and a top clip exterior surface (438); and the bottom barrier fence clip (500) has a bottom clip length (520), defined by the distance between the bottom clip attachment edge (540) and the bottom clip insertion edge (550), and a bottom clip width (530), defined by the distance between a bottom clip proximal edge (535) and a bottom clip distal edge (536), and a bottom clip interior surface (537), and a bottom clip exterior surface (538);

(i) the top clip location (405) and the top clip length (420) extends through one of the plurality of openings (640) and releasably secures the flexible barrier fencing (600) between the fence post sleeve exterior surface (350) and the top barrier fence clip (400), and the bottom clip location (505) and the bottom clip length (520) extends through one of the plurality of openings (640) and releasably secures the flexible barrier fencing (600) between the fence post sleeve exterior surface (350) and the bottom barrier fence clip (500);

(j) the interior minimum cross-sectional width (330) and the post maximum cross-sectional width (160) cooperate to releasably couple the fence post sleeve (300) to the fence post (100) by insertion of the fence post (100) into the post sleeve (300); and (k) the top barrier fence clip (400) releasably cooperates with a top clip receiving slot (360) formed in the fence post sleeve (300) having a top clip receiving slot sinistral edge (362) and a top clip receiving slot dextral edge (363), and a top clip receiving slot width (364), defined by the distance between a top clip receiving slot proximal edge (365) and a top clip receiving slot distal edge (366), wherein the top clip receiving slot (360) is located within the right sleeve portion (323) and the top barrier fence clip (400) is attached to the left sleeve portion (322), and the bottom barrier fence clip (500) releasably cooperates with a bottom clip receiving slot (370) formed in the fence post sleeve (300) having a bottom clip receiving slot sinistral edge (372) and a bottom clip receiving slot dextral edge (373), and a bottom clip receiving slot width (374), defined by the distance between a bottom clip receiving slot proximal edge (375) and a bottom clip receiving slot distal edge (376), wherein the bottom clip receiving slot (370) is located within the right sleeve portion (323) and the bottom barrier fence clip (500) is attached to the left sleeve portion (322).

2. The fence mounting device of claim 1, wherein the top barrier fence clip (400) and the bottom barrier fence clip (500) project from the longitudinal slit left edge (382).

3. The fence mounting device of claim 1, wherein the top barrier fence clip (400) is located within a top longitudinal slit clip recess (384) wherein a portion of the top longitudinal slit clip recess (384) is in contact with the longitudinal slit left edge (382), and the bottom barrier fence clip (500) is located within a bottom longitudinal slit clip recess (385) wherein a portion of the bottom longitudinal slit clip recess (385) is in contact with the longitudinal slit left edge (382).

4. The fence mounting device of claim 3, wherein the top barrier fence clip (400) releasably cooperates with a top clip receiving slot (360), wherein the top clip receiving slot (360) is located within the right sleeve portion (323) and the top barrier fence clip (400) is attached to the left sleeve portion (322); and the bottom barrier fence clip (500) releasably cooperates with a bottom clip receiving slot (370), wherein the bottom clip receiving slot (370) is located within the right sleeve portion (323) and the bottom barrier fence clip (500) is attached to the left sleeve portion (322).

5. A fence mounting device of claim 1, wherein the top clip insertion edge (450) is shaped to form a top clip insertion edge barb (460) having a top clip insertion edge barb width (470), wherein the top clip insertion edge barb width (470) is greater than the top clip receiving slot width (364), and the top clip width (430) is less than the top clip receiving slot width (364), such that the top barrier fence clip (400) must be twisted to permit the top clip insertion edge barb (460) to pass through the top clip receiving slot (360) and engage the fence post sleeve interior surface (340) when allowed to return to a top clip natural position (410), and the bottom clip insertion edge (550) is shaped to form a bottom clip insertion edge barb (560) having a bottom clip insertion edge barb width (570), wherein the bottom clip insertion edge barb width (570) is greater than the bottom clip receiving slot width (374), and the bottom clip width (530) is less than the bottom clip receiving slot width (374), such that the bottom barrier fence clip (500) must be twisted to permit the bottom clip insertion edge barb (560) to pass through the bottom clip receiving slot (370) and engage the fence post sleeve interior surface (340) when allowed to return to a bottom clip natural position (510).

6. The fence mounting device of claim 1, wherein the interior minimum cross-section width (330) is less than the post maximum cross-sectional width (160).

7. The fence mounting device of claim 1, wherein the fence post sleeve length (310) is greater than the post length (180).

8. The fence mounting device of claim 3, wherein the top clip insertion edge (450) does not extend past the longitudinal slit left edge (382), and the bottom clip insertion edge (550) does not extend past the longitudinal slit left edge (382).

9. A fence mounting device of claim 1, wherein the top clip insertion edge (450) is shaped to form a top clip insertion edge barb (460) having a top clip insertion edge barb width (470), and the top clip receiving slot (360) has a top clip receiving slot insertion slot (368) having a top clip receiving slot insertion slot width (369) located substantially orthogonal to the top clip receiving slot sinistral edge (362), wherein the top clip insertion edge barb width (470) is greater than the top clip receiving slot width (364) and less than the top clip receiving slot insertion slot width (369), and the top clip width (430) is less than the top clip receiving slot width (364), such that when the top clip insertion barb (460) is passed through the top clip receiving slot insertion slot (368) the top clip insertion barb (460) engages the fence post sleeve interior surface (340); and the bottom clip insertion edge (550) is shaped to form a bottom clip insertion edge barb (560) having a bottom clip insertion edge barb width (570), and the bottom clip receiving slot has a bottom clip receiving slot insertion slot (378) having a bottom clip receiving slot insertion slot width (379) located substantially orthogonal to the bottom clip receiving slot sinistral edge (372), wherein the bottom clip insertion edge barb width (570) is greater than the bottom clip receiving slot width (374) and less than the bottom clip receiving slot insertion slot width (379), and the bottom clip width (530) is less than the bottom clip receiving slot width (374), such that when the bottom clip insertion barb (560) is passed through the bottom clip receiving slot insertion slot (378) the bottom clip insertion barb (560) engages the fence post sleeve interior surface (340).

10. A fence mounting device, designed to be releasably attached to a fence post (100) having a post exterior surface (190), a post bottom end (140) and a post top end (120), wherein the distance between the post bottom end (140) and the post top end (120) defines a post length (180), and the fence post (100) has a post maximum cross-sectional width (160), wherein the fence mounting device to releasably secures a flexible barrier fencing (600), having a plurality of openings (640), to the fence post (100), the mounting device comprising:

a fence post sleeve (300) having:

(a) a fence post sleeve distal end (305) and a fence post sleeve proximal end (306), wherein the distance between the fence post sleeve distal end (305) and the fence post sleeve proximal end (306) defines a fence post sleeve length (310) having a fence post sleeve length midpoint (311) substantially equidistant from the fence post sleeve distal end (305) and the fence post sleeve proximal end (306);

(b) a fence post sleeve longitudinal slit (380), extending from the fence post sleeve distal end (305) to the fence post sleeve proximal end (306), having a fence post sleeve longitudinal slit separation distance (381), with a longitudinal slit left edge (382) and a longitudinal slit right edge (383);

(c) a fence post sleeve width (320) and a fence post sleeve width midpoint (321) substantially equidistant from the longitudinal slit left edge (382) and the longitudinal slit right edge (383);

(d) a left sleeve portion (322) extending from the longitudinal slit left edge (382) to the fence post sleeve width midpoint (321) and bounded by the fence post sleeve distal end (305) and the fence post sleeve proximal end (306);

(e) a right sleeve portion (323) extending from the longitudinal slit right edge (383) to the fence post sleeve width midpoint (321) and bounded by the fence post sleeve distal end (305) and the fence post sleeve proximal end (306);

(f) a fence post sleeve interior surface (340), an interior minimum cross-sectional width (330), and a fence post sleeve exterior surface (350);

(g) a fence post sleeve central axis (307), substantially parallel to the fence post sleeve longitudinal slit (380) extending from the fence post sleeve distal end (305) to the fence post sleeve proximal end (306) and positioned at a midpoint of the interior minimum cross-sectional width (330);

(h) at least one top barrier fence clip (400) at a top clip location (405) between the fence post sleeve length midpoint (311) and the fence post sleeve proximal end (306), and at least one bottom barrier fence clip (500) at a bottom clip location (505) between the fence post sleeve length midpoint (311) and the fence post sleeve distal end (305) wherein;

(i) the top barrier fence clip (400) is oriented substantially orthogonal to the fence post sleeve central axis (307), wherein the top barrier fence clip (400) is located within a top longitudinal slit clip recess (384) wherein a portion of the top longitudinal slit clip recess (384) is in contact with the longitudinal slit left edge (382), and the bottom barrier fence clip (500) is oriented substantially orthogonal to the fence post sleeve central axis (307), and the bottom barrier fence clip (500) is located within a bottom longitudinal slit clip recess (385) wherein a portion of the bottom longitudinal slit clip recess (385) is in contact with the longitudinal slit left edge (382);

(ii) the top barrier fence clip (400) has a top clip attachment edge (440) and a top clip insertion edge (450), and the bottom barrier fence clip (500) has a bottom clip attachment edge (540) and a bottom clip insertion edge (550);

(iii) the top barrier fence clip (400) has a top clip length (420), defined by the distance between the top clip attachment edge (440) and the top clip insertion edge (450), and a top clip width (430), defined by the distance between a top clip proximal edge (435) and a top clip distal edge (436), and a top clip interior surface (437), and a top clip exterior surface (438); and the bottom barrier fence clip (500) has a bottom clip length (520), defined by the distance between the bottom clip attachment edge (540) and the bottom clip insertion edge (550), and a bottom clip width (530), defined by the distance between a bottom clip proximal edge (535) and a bottom clip distal edge (536), and a bottom clip interior surface (537), and a bottom clip exterior surface (538);

(i) the top clip location (405) and the top clip length (420) extends through one of the plurality of openings (640) and releasably secures the flexible barrier fencing (600) between the fence post sleeve exterior surface (350) and the top barrier fence clip (400), and the bottom clip location (505) and the bottom clip length (520) extends through one of the plurality of openings (640) and releasably secures the flexible barrier fencing (600) between the fence post sleeve exterior surface (350) and the bottom barrier fence clip (500); and (j) the interior minimum cross-sectional width (330) and the post maximum cross-sectional width (160) cooperate to releasably couple the fence post sleeve (300) to the fence post (100) by insertion of the fence post (100) into the post sleeve (300).

11. The fence mounting device of claim 10, wherein the top barrier fence clip (400) releasably cooperates with a top clip receiving slot (360), wherein the top clip receiving slot (360) is located within the right sleeve portion (323) and the top barrier fence clip (400) is attached to the left sleeve portion (322); and the bottom barrier fence clip (500) releasably cooperates with a bottom clip receiving slot (370), wherein the bottom clip receiving slot (370) is located within the right sleeve portion (323) and the bottom barrier fence clip (500) is attached to the left sleeve portion (322).

12. The fence mounting device of claim 10, wherein the top clip insertion edge (450) does not extend past the longitudinal slit left edge (382), and the bottom clip insertion edge (550) does not extend past the longitudinal slit left edge (382).

13. A fence mounting device, designed to be releasably attached to a fence post (100) having a post exterior surface (190), a post bottom end (140) and a post top end (120), wherein the distance between the post bottom end (140) and the post top end (120) defines a post length (180), and the fence post (100) has a post maximum cross-sectional width (160), wherein the fence mounting device to releasably secures a flexible barrier fencing (600), having a plurality of openings (640), to the fence post (100), the mounting device comprising:

a fence post sleeve (300) having:

(a) a fence post sleeve distal end (305) and a fence post sleeve proximal end (306), wherein the distance between the fence post sleeve distal end (305) and the fence post sleeve proximal end (306) defines a fence post sleeve length (310) having a fence post sleeve length midpoint (311) substantially equidistant from the fence post sleeve distal end (305) and the fence post sleeve proximal end (306);

(b) a fence post sleeve longitudinal slit (380), extending from the fence post sleeve distal end (305) to the fence post sleeve proximal end (306), having a fence post sleeve longitudinal slit separation distance (381), with a longitudinal slit left edge (382) and a longitudinal slit right edge (383);

(c) a fence post sleeve width (320) and a fence post sleeve width midpoint (321) substantially equidistant from the longitudinal slit left edge (382) and the longitudinal slit right edge (383);

(d) a left sleeve portion (322) extending from the longitudinal slit left edge (382) to the fence post sleeve width midpoint (321) and bounded by the fence post sleeve distal end (305) and the fence post sleeve proximal end (306);

(e) a right sleeve portion (323) extending from the longitudinal slit right edge (383) to the fence post sleeve width midpoint (321) and bounded by the fence post sleeve distal end (305) and the fence post sleeve proximal end (306);

(f) a fence post sleeve interior surface (340), an interior minimum cross-sectional width (330), and a fence post sleeve exterior surface (350);

(g) a fence post sleeve central axis (307), substantially parallel to the fence post sleeve longitudinal slit (380) extending from the fence post sleeve distal end (305) to the fence post sleeve proximal end (306) and positioned at a midpoint of the interior minimum cross-sectional width (330);

(h) at least one top barrier fence clip (400) at a top clip location (405) between the fence post sleeve length midpoint (311) and the fence post sleeve proximal end (306), and at least one bottom barrier fence clip (500) at a bottom clip location (505) between the fence post sleeve length midpoint (311) and the fence post sleeve distal end (305) wherein;

(i) the top barrier fence clip (400) is oriented substantially orthogonal to the fence post sleeve central axis (307), wherein the top barrier fence clip (400) is located within a top longitudinal slit clip recess (384) wherein a portion of the top longitudinal slit clip recess (384) is in contact with the longitudinal slit left edge (382), and the bottom barrier fence clip (500) is oriented substantially orthogonal to the fence post sleeve central axis (307), and the bottom barrier fence clip (500) is located within a bottom longitudinal slit clip recess (385) wherein a portion of the bottom longitudinal slit clip recess (385) is in contact with the longitudinal slit left edge (382);

(ii) the top barrier fence clip (400) has a top clip attachment edge (440) and a top clip insertion edge (450), and the bottom barrier fence clip (500) has a bottom clip attachment edge (540) and a bottom clip insertion edge (550);

(iii) the top barrier fence clip (400) has a top clip length (420), defined by the distance between the top clip attachment edge (440) and the top clip insertion edge (450), and a top clip width (430), defined by the distance between a top clip proximal edge (435) and a top clip distal edge (436), and a top clip interior surface (437), and a top clip exterior surface (438); and the bottom barrier fence clip (500) has a bottom clip length (520), defined by the distance between the bottom clip attachment edge (540) and the bottom clip insertion edge (550), and a bottom clip width (530), defined by the distance between a bottom clip proximal edge (535) and a bottom clip distal edge (536), and a bottom clip interior surface (537), and a bottom clip exterior surface (538); and the top barrier fence clip (400) releasably cooperates with a top clip receiving slot (360), wherein the top clip receiving slot (360) is located within the right sleeve portion (323) and the top barrier fence clip (400) is attached to the left sleeve portion (322); and the bottom barrier fence clip (500) releasably cooperates with a bottom clip receiving slot (370), wherein the bottom clip receiving slot (370) is located within the right sleeve portion (323) and the bottom barrier fence clip (500) is attached to the left sleeve portion (322);

(iv) the top clip insertion edge (450) does not extend past the longitudinal slit left edge (382), and the bottom clip insertion edge (550) does not extend past the longitudinal slit left edge (382);

(i) the top clip location (405) and the top clip length (420) extends through one of the plurality of openings (640) and releasably secures the flexible barrier fencing (600) between the fence post sleeve exterior surface (350) and the top barrier fence clip (400), and the bottom clip location (505) and the bottom clip length (520) extends through one of the plurality of openings (640) and releasably secures the flexible barrier fencing (600) between the fence post sleeve exterior surface (350) and the bottom barrier fence clip (500); and (j) the interior minimum cross-sectional width (330) and the post maximum cross-sectional width (160) cooperate to releasably couple the fence post sleeve (300) to the fence post (100) by insertion of the fence post (100) into the post sleeve (300).

* * * * *